US009751672B2

(12) United States Patent
Butterworth

(10) Patent No.: US 9,751,672 B2
(45) Date of Patent: Sep. 5, 2017

(54) LOAD CAPPING ARRANGEMENT

(71) Applicant: LOADHOG LIMITED, South Yorkshire (GB)

(72) Inventor: John Butterworth, West Yorkshire (GB)

(73) Assignee: LOADHOG LIMITED (GB)

( * ) Notice: Subject to any disclaimer, the term of this patent is extended or adjusted under 35 U.S.C. 154(b) by 0 days.

(21) Appl. No.: 14/762,075

(22) PCT Filed: Jan. 20, 2014

(86) PCT No.: PCT/GB2014/000016

§ 371 (c)(1),
(2) Date: Jul. 20, 2015

(87) PCT Pub. No.: WO2014/114901

PCT Pub. Date: Jul. 31, 2014

(65) Prior Publication Data

US 2016/0001947 A1 Jan. 7, 2016

(30) Foreign Application Priority Data

| | | |
|---|---|---|
| Jan. 22, 2013 | (GB) | 1301056.6 |
| May 22, 2013 | (GB) | 1309219.2 |
| Nov. 21, 2013 | (GB) | 1320590.1 |
| Jan. 17, 2014 | (GB) | 1400775.1 |

(51) Int. Cl.

| | |
|---|---|
| ***B65D 71/70*** | (2006.01) |
| ***B65D 71/00*** | (2006.01) |
| ***B65D 71/42*** | (2006.01) |
| ***B65D 71/50*** | (2006.01) |

(52) U.S. Cl.

CPC ..... *B65D 71/70* (2013.01); *B65D 71/0096* (2013.01); *B65D 71/42* (2013.01); *B65D 71/50* (2013.01); *B65D 2571/00055* (2013.01)

(58) Field of Classification Search

CPC .. B65D 5/005; B65D 19/003; B65D 19/0061; B65D 19/0077

USPC ..... 206/427, 432, 386, 597, 586, 497; 108/57.17, 57.16, 51.11, 55.1, 56.1, 56.3, 108/51.3

See application file for complete search history.

(56) References Cited

U.S. PATENT DOCUMENTS

| | | | | |
|---|---|---|---|---|
| 2,313,731 A | | 3/1943 | Brogden | |
| 3,487,918 A | | 1/1970 | Roden et al. | |
| 3,654,876 A | * | 4/1972 | Achs | B65D 19/0048 108/57.16 |

(Continued)

FOREIGN PATENT DOCUMENTS

| | | |
|---|---|---|
| DE | 8328912 | 12/1983 |
| DE | 19824255 | 12/1999 |

(Continued)

*Primary Examiner* — King M Chu

(74) *Attorney, Agent, or Firm* — Clark Hill PLC; James R. Foley

(57) ABSTRACT

A load capping arrangement (10) for stabilizing a load (100) comprising a plurality of articles (102) is disclosed. The load capping arrangement comprises a central region (12) for engaging at least some of the articles. A rim arrangement (15) extends around the central region and the rim arrangement is deformable from a non-deformed condition to a deformed condition around the load.

16 Claims, 29 Drawing Sheets

(56) References Cited

U.S. PATENT DOCUMENTS

| | | | | |
|---|---|---|---|---|
| 4,036,362 | A | 7/1977 | Ullman | |
| 4,570,546 | A * | 2/1986 | Batelka | B65D 19/00 108/51.3 |
| 5,139,145 | A | 8/1992 | Cook | |
| 5,881,651 | A * | 3/1999 | Trickett | B65D 19/36 108/51.11 |
| 6,899,225 | B2 * | 5/2005 | Shuert | B65D 85/676 108/55.1 |
| 2002/0002937 | A1 * | 1/2002 | Modesitt | B65D 19/0002 108/57.34 |
| 2008/0017650 | A1 | 1/2008 | Evans et al. | |
| 2008/0022905 | A1 * | 1/2008 | Trickett | B65D 19/36 108/57.16 |
| 2011/0215016 | A1 | 9/2011 | Block | |

FOREIGN PATENT DOCUMENTS

| | | |
|---|---|---|
| DE | 202008014502 | 2/2009 |
| EP | 0067656 | 12/1982 |
| EP | 1281629 | 2/2003 |
| FR | 2515140 | 4/1983 |
| FR | 2581038 | 10/1986 |

* cited by examiner

LOAD CAPPING ARRANGEMENT

This invention relates to load capping arrangements for stabilising loads comprising a plurality of articles, such as bottles arranged in an upright position.

The handling of bottles often requires them to be transported on pallets. This involves arranging the bottles in layers on a pallet with a slip sheet between each layer. A slip sheet can also be placed on the upper layer to stabilise it, but problems can be caused by the use of a slip sheet when the pallet is wrapped in a shroud, and as a result of the slip sheet failing to engage all the bottles in the upper layer, thereby failing to retain the upper layer of bottles.

According to one aspect of this invention, there is provided a load capping arrangement for stabilising a load which comprises a plurality of articles, wherein the load capping arrangement comprises a central region for engaging at least some of the articles, and a rim arrangement extending around the central region, the rim arrangement being deformable from a non-deformed condition to a deformed condition around the load.

The central region may have a substantially planar surface. The central region may be substantially planar.

The rim arrangement may be configured to engage a wrapping applied around the load to restrict the engagement of the wrapping with the articles.

The rim arrangement may be resilient, and may be resiliently deformable from the non-deformed condition to the deformed condition. The rim arrangement may be capable of resiliently returning from the deformed condition to the non-deformed condition The rim arrangement may be resiliently deformable to one of a plurality of deformed conditions around the load. The load capping arrangement may be formed of a resilient material. Alternatively, the rim arrangement may be formed of a resilient material. The resilient material may be an elastomeric material.

The load capping arrangement may have a substantially polygonal configuration. In one embodiment, the load capping arrangement may have substantially square configuration. The load capping arrangement may comprise a plurality of sides adjacent one another, and a respective corner region between adjacent sides.

The central region may a periphery and may comprise a plurality of sides defining the periphery. The rim arrangement may comprise a plurality of rim portions, each extending from the central region. Each rim portion may extend along the length of a respective side of the central region.

The rim arrangement may be deformable to extend from the non-deformed condition in which the rim arrangement is substantially co-planar with, or parallel to, said substantially planar surface, to the deformed condition transverse to said substantially planar surface. The rim arrangement may be deformable by the application of the wrapping to the load, thereby restricting engagement of the wrapping with the articles when the rim arrangement is in the deformed condition. Where the rim arrangement comprises a plurality of rim portions, each rim portion may be deformable to extend from a non-deformed condition in which the rim portion is substantially co-planar with, or parallel to, said substantially planar surface, to the deformed condition transverse to said substantially planar surface The central region may comprise a substantially planar member.

In one embodiment, the central region may be formed of a rigid material and the rim arrangement may be formed of a resiliently deformable material. The central region may be formed of a plastics material.

The rim arrangement may be formed of an elastomeric material, such as a rubber material, and may be resiliently deformable between the non-deformed and the deformed conditions.

The rim arrangement may have an article engaging surface. The rim arrangement may be attached to the central region with the article engaging surface of the rim arrangement substantially co-planar with, or parallel to, the aforesaid planar surface of the central region when the rim arrangement is in the non-deformed condition. Alternatively, where the rim arrangement and the central region are substantially planar, the rim arrangement may extend co-planar with, or parallel with, the central region.

In a further embodiment, the central region may comprise a resilient sheet, which may be an elastomeric sheet, such as a rubber sheet.

The load capping arrangement may include reinforcing means on the central region. The reinforcing means may comprise a frame. The frame may be an outer frame, and may be arranged around the periphery of the central region.

The rim arrangement may be formed of a resiliently deformable material, such as an elastomeric material and may be formed of rubber. The rim arrangement may extend outwardly from the reinforcing means. The rim arrangement may constitute a part of the resilient sheet forming the central region. In one embodiment, the rim arrangement and the central region may be a unitary component.

The frame may be formed of a rigid material, for example a rigid plastics material.

In another embodiment, the central portion may comprise a rigid member, for example formed of a rigid plastics material.

The rim arrangement may comprise a foldable member attached to the central region. The foldable member may be connected to the central region at hinges.

The rim arrangement may comprise a plurality of foldable members attached to one another at hinges. The hinges may comprise hinge lines extending across the foldable member. The hinge lines may extend parallel to each other.

Each of the hinges may comprise a live hinge. Alternatively, at least some of the hinges may comprise mechanical hinges.

The rim arrangement may have a surface co-planar with the engaging surface. The rim arrangement may be substantially planar. Where the central region is substantially planar, the rim arrangement may be substantially co-planar with the substantially planar central region.

In at least one embodiment, the load capping arrangement may comprise a plurality of rim portions. Each rim portion may extend from the periphery of the central region.

In a further embodiment, the rim arrangement may comprise a plurality of torsion bars, which may be elongate and may be parallel to the periphery of the central region from which the rim arrangement extends. Each rim portion may comprise a plurality of the torsion bars.

Each torsion bar may be a resiliently deformable hinge, which may allow twisting of the rim arrangement to the deformed condition about the torsion bar on application of a force thereto, and may return the rim arrangement to the non-deformed condition on release of the aforesaid force. Thus, n the relevant embodiments described herein, the torsion bars allow the rim arrangement to deform around the load, thereby transmitting the pressure applied by the shroud away from the load.

The rim arrangement may comprise a plurality of elongate members. Each elongate member may be parallel to the periphery of the central region from which the rim arrangement extends. Each torsion bar may be a portion of one of the elongate members.

In this embodiment, the rim arrangement may comprise a deformable region. Each rim portion may comprise a deformable region defining a plurality of formations. Each formation may be selected from the group comprising an aperture and a recess. The formations may be arranged in rows extending substantially parallel to the respective periphery of the central region.

The load may have a peripheral region and a plurality of the articles may form the peripheral region.

In one embodiment, the formations may be configured to receive portions of the articles. The formations may be configured to receive portions of the articles arranged at the periphery of the load. The formations may be configured to hold the articles at the periphery of the load.

The deformable region may comprise an apertured region, which may define a plurality of apertures. The apertures may be elongate slots. Alternatively, the deformable region may comprise a recessed region, which may define a plurality of recesses. Each recess may be elongate. Each recess may have a membrane extending thereacross.

The deformable region may include a plurality of downwardly extending projections provided to engage the load. In one embodiment, the formations have edges, and the projections may be provided at one or more of the edges of the formations.

The projections may be provided along the edges of the formations closest to the periphery of the central region. The projections may be configured to hold the articles at the periphery of the load. Each article in the peripheral region may be engaged by two projections.

In this embodiment, the torsion bars may be provided between adjacent apertures or recesses. Preferably, the torsion bars extend substantially parallel to the respective periphery of the central region from which the rim arrangement extends. The torsion bars may be arranged between adjacent rows of apertures or recesses. The torsion bars may define the apertures or recesses therebetween.

Connecting members may extend between adjacent elongate members. Each aperture or recess may be defined between adjacent connecting members.

The rim arrangement may include a plurality of connecting members extending between the torsion bars in adjacent rows of torsion bars. Each rim portion may include a plurality of connecting members extending between the torsion bars in adjacent rows of torsion bars. Each torsion bar may extend between adjacent connecting members.

In a further embodiment, a lip arrangement may extend around the rim arrangement. The lip arrangement may curve downwardly from the rim arrangement. The lip arrangement may comprise a plurality of lip members defining gaps therebetween.

The lip arrangement may comprise a plurality of side lip members. Each side lip member may extend along a respective one of the rim portions of the load capping arrangement. Each side lip member may curve downwardly from the respective rim portion. Alternatively, each lip member may curve upwardly from the respective rim portion.

In this embodiment, the rim arrangement may comprise a plurality of corner portions extending between adjacent rim portions. In one embodiment, each corner portion may comprise a plurality of corner formations to allow the corner portion to be deformed around articles disposed at the corner of the load. The formations of the corner portion may extend diagonally relative to the formations in adjacent rim portions.

In another embodiment, each corner portion may be substantially solid, being devoid of the formations, such as recesses or apertures, to facilitate deformation of the corner portion. With this embodiment, the corner portions remain in a non-deformed condition, when the rim portions deform to the deformed condition about the load.

In a further embodiment, the corner portions may have elongate corner formations extending from the formations of each of the two the adjacent rim portions. Each corner formation may be substantially L shaped, and may have a bend, which may be a right angled bend, to allow it to extend around the respective corner. A region of each corner formation may extend substantially parallel to the formations of the adjacent rim portions. Each corner formation may have a first region extending from one of the formations of one of the adjacent rim portions. Each corner formation may have a second region extending from one of the formations of the other of the adjacent rim portions. The first and second regions of each corner formation may extend substantially perpendicular to each other.

In yet another embodiment, each corner portion may have a curved edge. Each corner portion may have a corner lip member which may be curved. Each corner lip member may be convexly curved. Each corner lip member may define a plurality of notches to facilitate the deformation of the corner portion to the deformed condition. In this embodiment, the corner portion may define a plurality of apertures which may be elongate and may be curved.

The lip arrangement may include a plurality of corner lip members. Each corner lip member may extend around a respective corner portion. Each corner lip member may curve downwardly from the corner portion. Alternatively, each corner lip member may curve upwardly from the corner portion.

The lip arrangement may comprise a plurality of centring structures to allow the load capping arrangement to be centred on the bad by a manipulating apparatus. Each centring structure may comprise a raised region of the lip arrangement. Each raised region may comprise an engagement surface for engaging the manipulating apparatus.

Each engagement surface desirably extends transverse to the central region. Suitably, each engagement surface extends substantially at right angles to the central region. Each engagement surface may present a face outwardly from the lip arrangement. The face may extend transverse to the central region, and may be substantially perpendicular thereto. In use, the face may extend substantially vertically. Each engagement surface may be substantially V or U shaped. Alternatively, the engagement surface may be any other suitable shape.

The centring structures may be provided on the side lip members. In use, the engagement surfaces may extend substantially vertically.

A centring apparatus may apply a force at right angles to each engagement surface, thereby moving the load capping arrangement to a substantially central position on the load. The, or each, force may be a horizontal force. The centring apparatus may comprise a plurality of force applying members for engaging the load capping arrangement on each respective edge and applying the aforesaid force to each engagement surface. Each force applying member may comprise a buffer.

Embodiments of the invention will now be described by way of example only, with reference to the accompanying drawings, in which.

Figure 1:
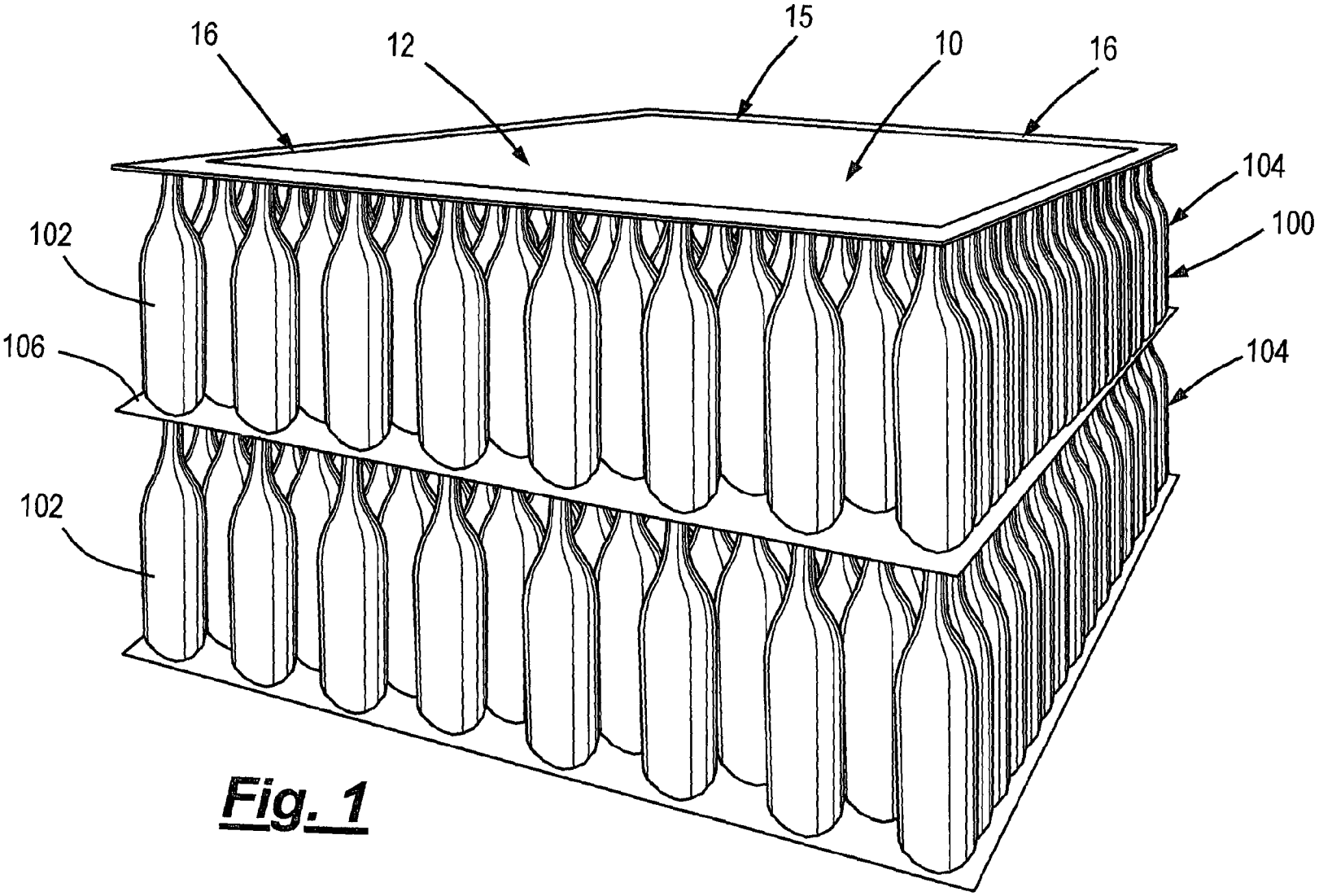
FIG. 1 is a perspective view of a load comprising a plurality of articles with a first embodiment of a load capping arrangement thereon.
Figure 2:
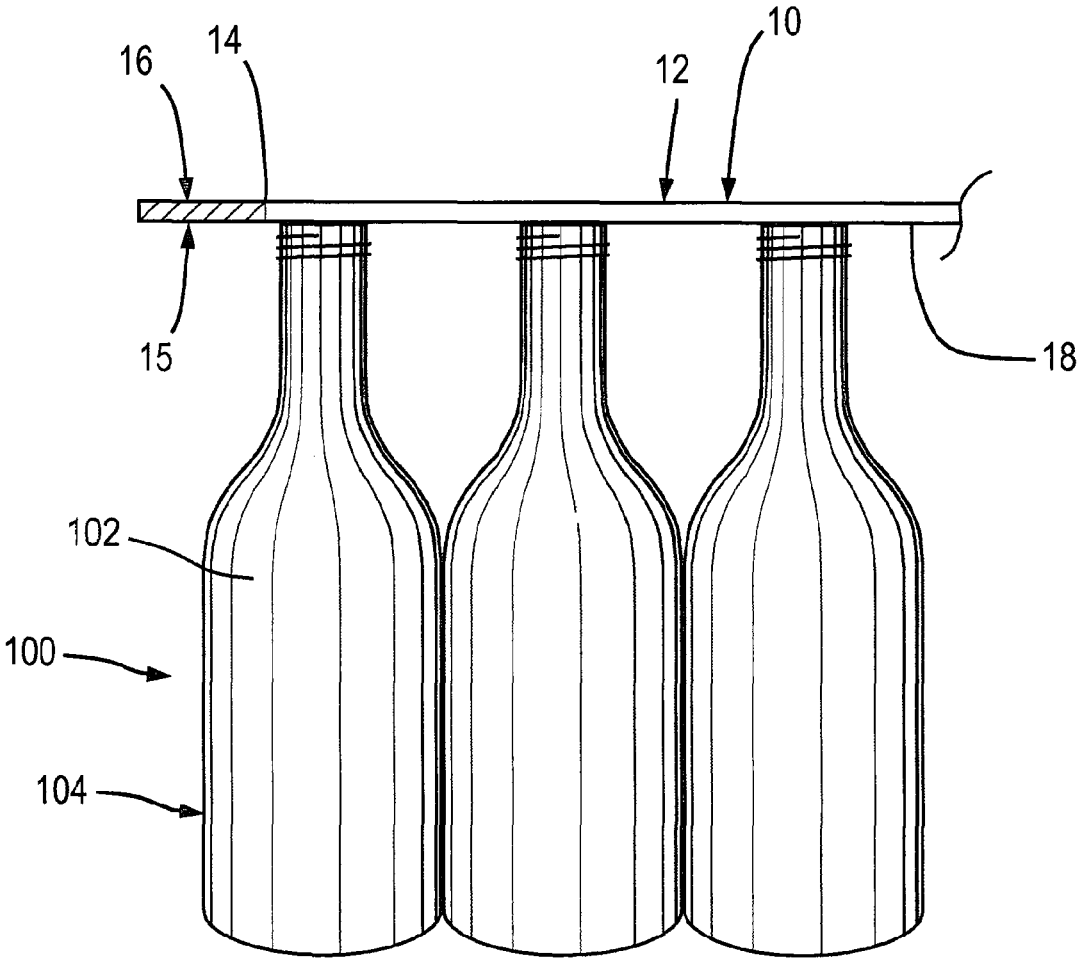
FIG. 2 is a close up cross sectional view of an edge region of the first embodiment of the load capping arrangement shown in FIG. 1 with a rim arrangement in a non-deformed condition.
Figure 4:
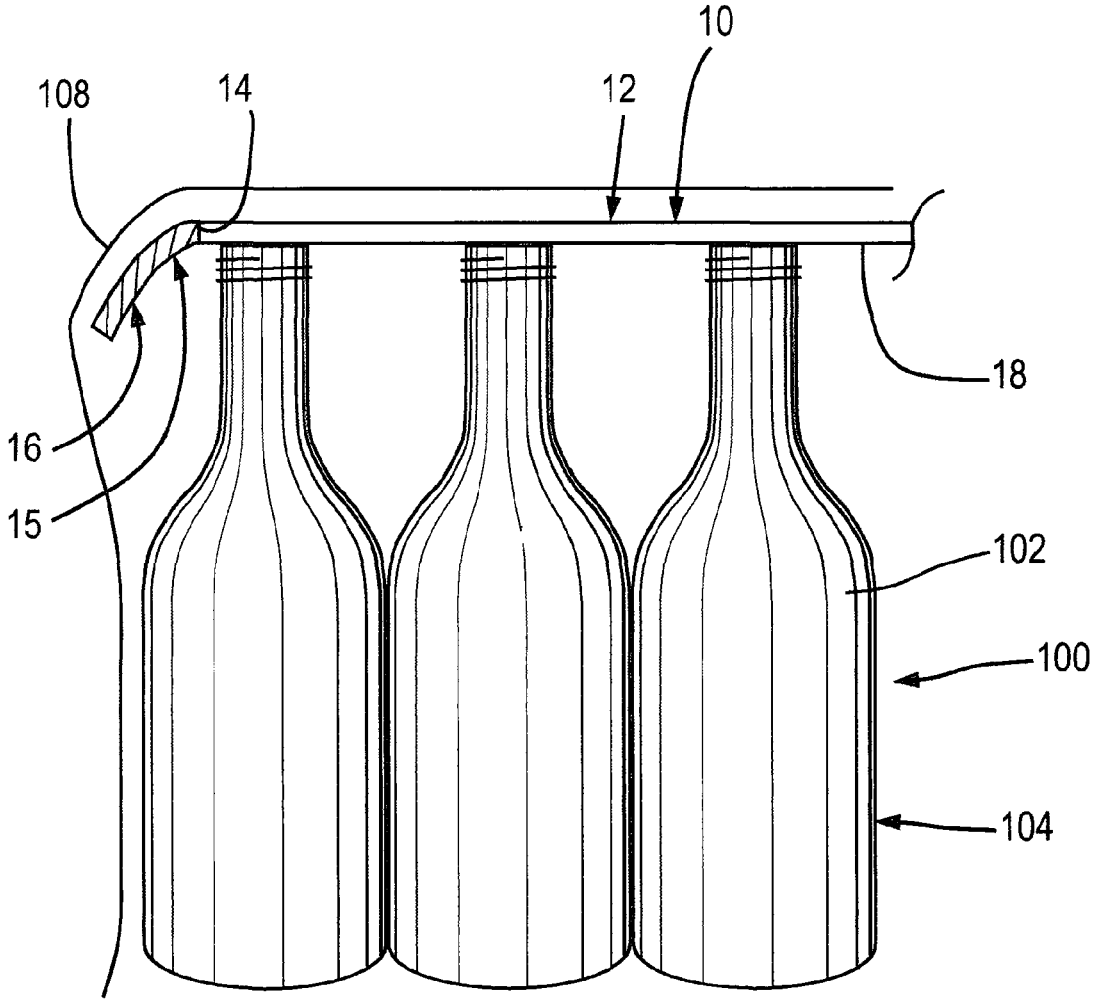
FIG. 4 is a view similar to FIG. 2 of the first embodiment of the load capping arrangement with a wrapping applied thereto and with the rim arrangement in a deformed condition.

Referring to FIGS. 1, 2 and 4, a load capping arrangement 10 is shown, disposed on a load 100 comprising a plurality of stacked articles, in the form of bottles 102. The stack of the bottles 102 is arranged on a pallet (not shown) in layers 104, where each layer 104 is separated from the one below by a slip sheet 106. The purpose of the load capping arrangement 10 is to stabilise the load 100 during transport, for example on conveyor belts.

The load capping arrangement 10 is generally rectangular in configuration and comprises a substantially planar central region 12 formed of a rigid plastics material. The central region has an edge 14 (see FIG. 2) extending therearound. A resiliently deformable rim arrangement 15 is attached to the periphery 14 of the central region 12.

In the embodiment shown in FIG. 1, the rim arrangement 15 comprises a plurality of rim portions 16, each extending along a respective one of the peripheries 14 of the rectangular central region 12. Alternatively, the load capping arrangement 10 comprises a single rectangular rim arrangement 15 extending around all the peripheries 14 of the central region 12.

The rim arrangement 15 is formed of a resilient elastomeric material, such as rubber, and is deformable from a non-deformed condition to a deformed condition. In the non-deformed condition, shown in FIG. 2, the rim arrangement 15 extends substantially co-planar with the central region 12. In the deformed condition, shown in FIG. 4, the rim arrangement 15 extends generally transverse to the central region 12.

The central region 12 has a substantially a planar engaging surface 18 for engaging the bottles 102.

When the load capping arrangement 10 is disposed on the upper layer 104 of the bottles 102, it extends across the whole of the top layer 104 and its weight acts to stabilise the bottles 102. The rim arrangement 15 extends beyond the outermost bottles 102 and serves to retain them in position.

The load 100 may have a wrapping 108 (see FIG. 4), in the form of a shroud, applied thereto, for example to secure the bottles 102 in the load 100. When the wrapping 108 is applied, it deforms the rim arrangement 15 into its deformed condition so that the rim arrangement 15 extends downwardly from the central region 12 across the bottles 102. This prevents the outermost bottles 102 of the upper layer 104 from being pushed off the pallet as the wrapping 108 is applied.

Figure 3:
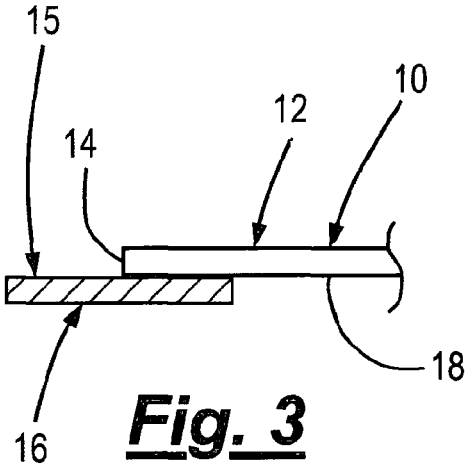
FIG. 3 is a sectional view of a rim arrangement of a second embodiment of the load capping arrangement with the rim arrangement in a non-deformed condition.

The rim arrangement 15 may be attached directly to the periphery 14 of the central region 12, where the rim arrangement 15 is substantially co-planar with the central region 12, when the rim arrangement 15 is in the non-deformed condition, as shown in FIG. 2. Alternatively, in a second embodiment, shown in FIG. 3, the rim arrangement 15 may be attached to the engaging surface 18 of the central region 14. In the second embodiment, when the rim arrangement 15 is in the non-deformed condition, the rim arrangement 15 is not co-planar with the central region 12 but is substantially parallel therewith.

Figure 5:
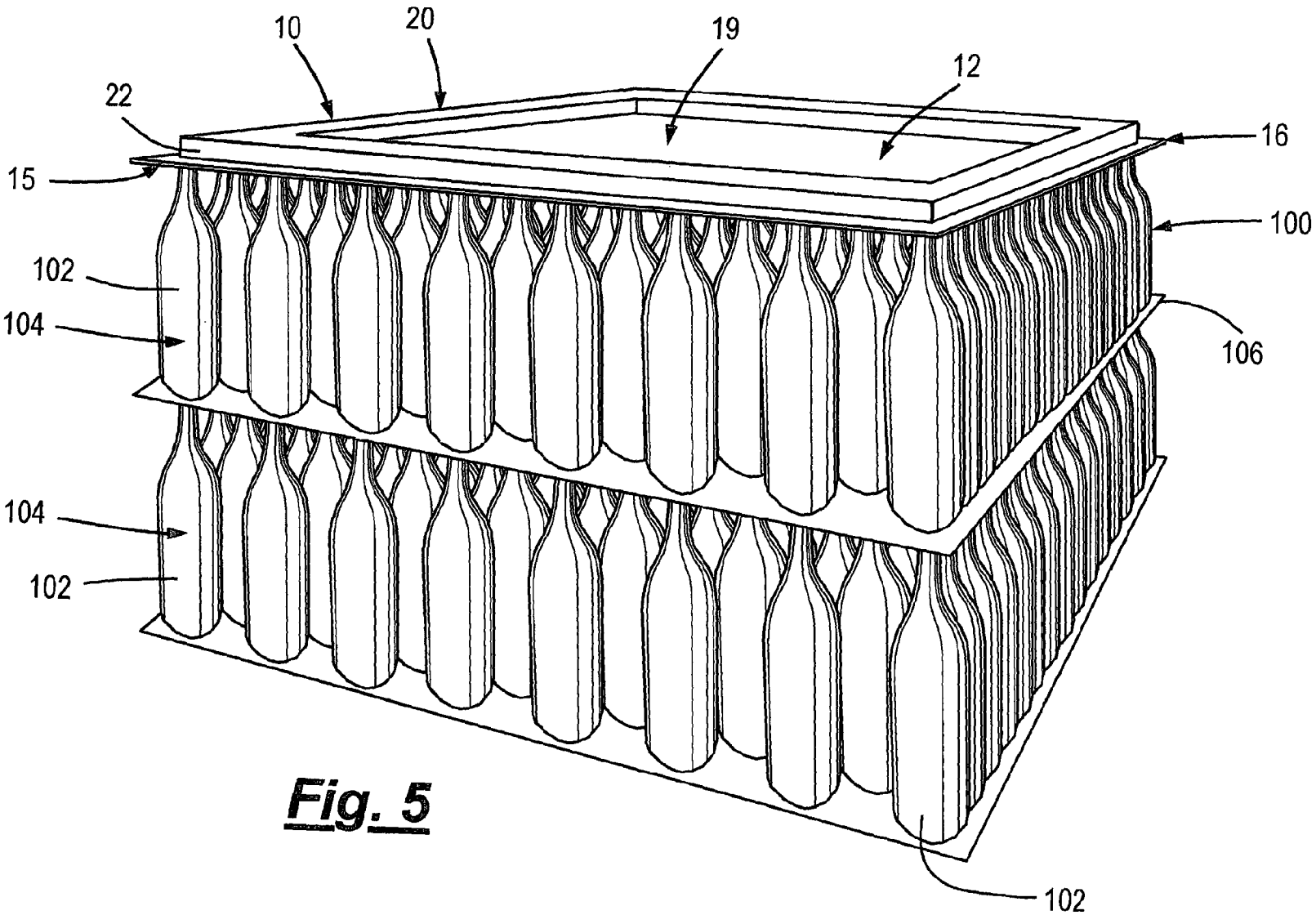
FIG. 5 is a perspective view of a load comprising a plurality of articles with a third embodiment of a load capping arrangement thereon.
Figure 6:
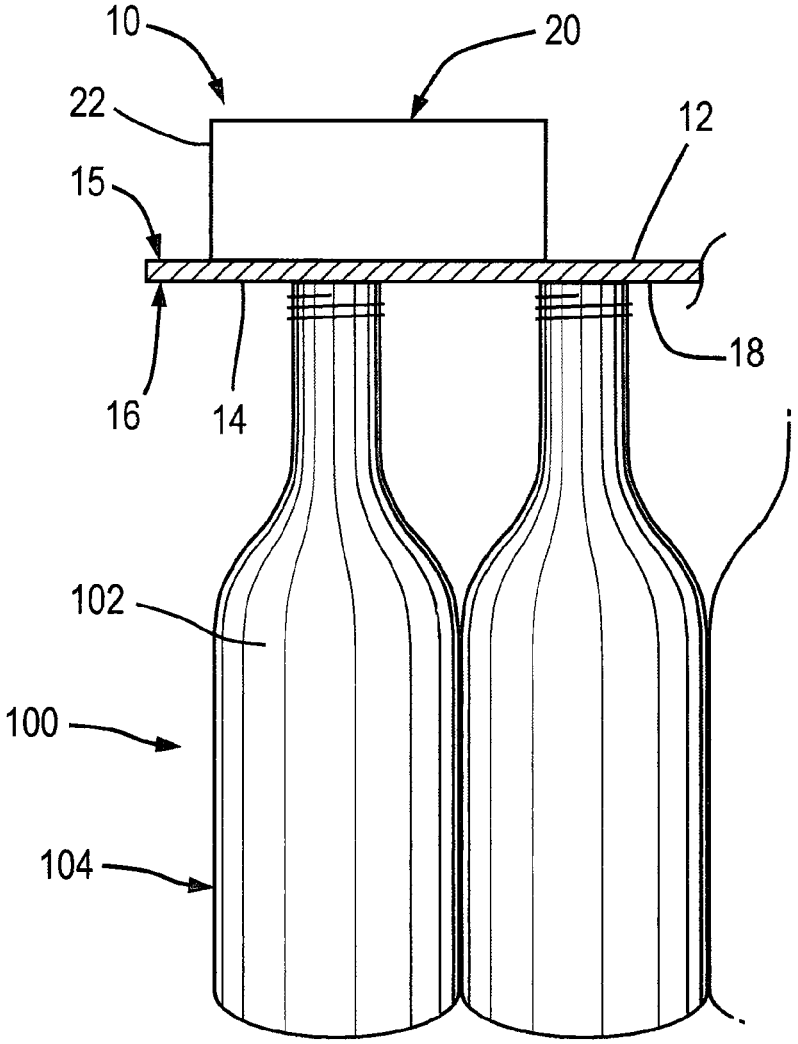
FIG. 6 is a close up cross sectional view of a rim arrangement of a third embodiment of the load capping arrangement shown in FIG. 5.
Figure 7:
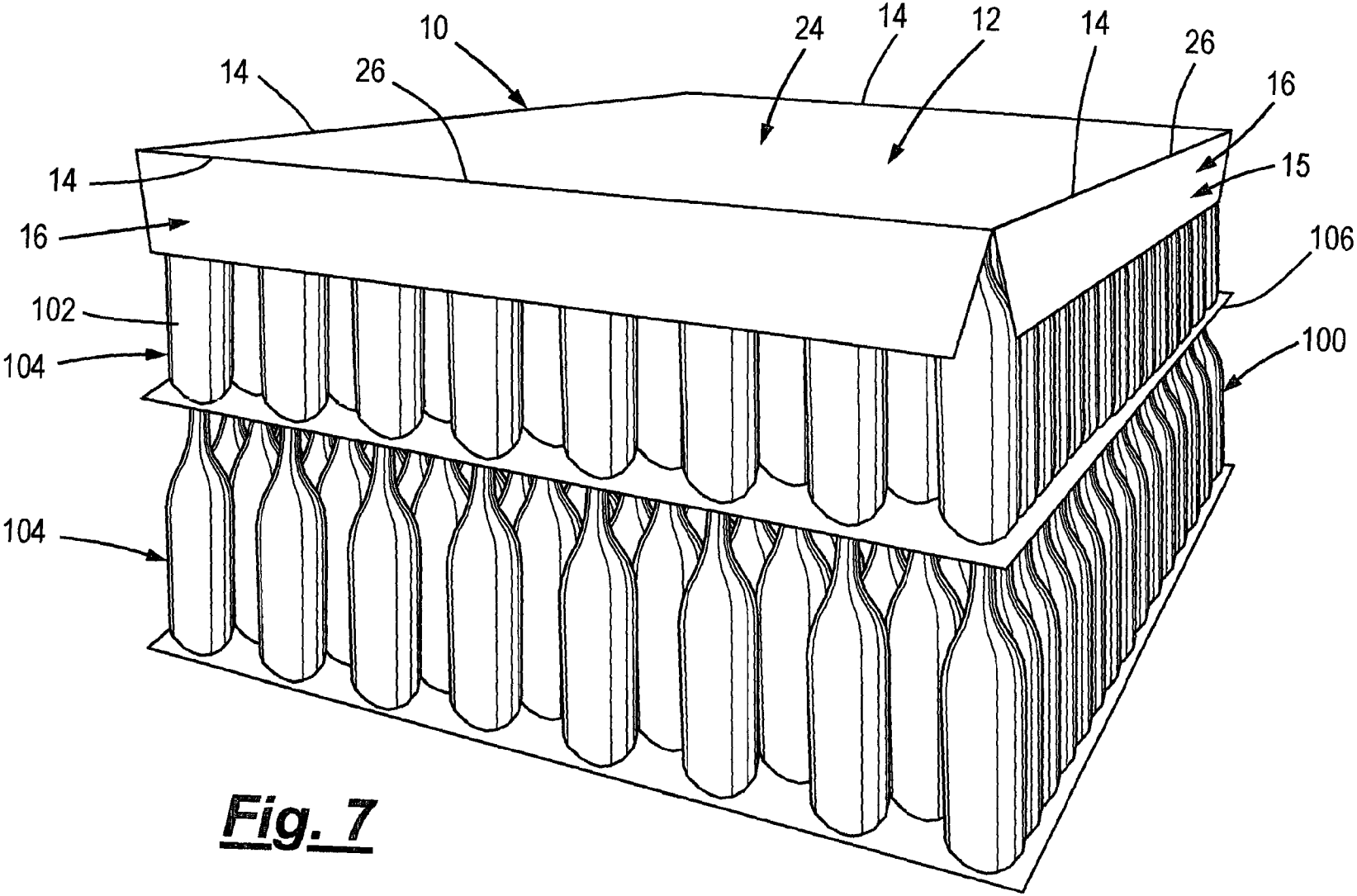
FIG. 7 is a perspective view of a load comprising a plurality of articles with a fourth embodiment of a load capping arrangement thereon.

A third embodiment of the load capping arrangement 10 is shown in FIGS. 5 and 6, in which the central region 12 and the rim arrangement 15 are in the form of a one piece elastomeric sheet 19 formed, for example, of rubber. In this embodiment, the load capping arrangement 10 further includes a rectangular frame 20 having an outer periphery 22. The frame 20 is formed of a rigid plastics material.

The frame 20 is mounted on the sheet 19. The frame 20 is slightly smaller than the sheet 19, so that the outer periphery 22 of the frame 20 defines the position of the periphery 14 of the central region 12. The rim arrangement 15 extends outwardly from the outer periphery 22 of the frame 20.

In use, when the load capping arrangement 10 is disposed on the upper layer 104 of the stack of bottles 102, the outer periphery 22 of the frame 20 is substantially aligned with the outermost bottles 102 in the upper layer 104. The rim arrangement 15 extends outwardly therefrom and is deformed to the deformed condition, when the wrapping 108 is applied. In the deformed condition, in the same way as shown in FIG. 4, the rim arrangement 15 extends downwardly across the outermost bottles 102 in the upper layer 104.

A fourth embodiment is shown in FIGS. 7 to 12, in which the load capping arrangement 10 is formed of a plastic sheet 24 comprising the central region 12 and the rim arrangement 15 comprises a plurality of rim portions 16 extending outwardly from the peripheries 14 of the central region 12. Each rim portion 16 is foldably attached to the central region at a first hinge line 26 in the form of a live hinge.

Figure 9:
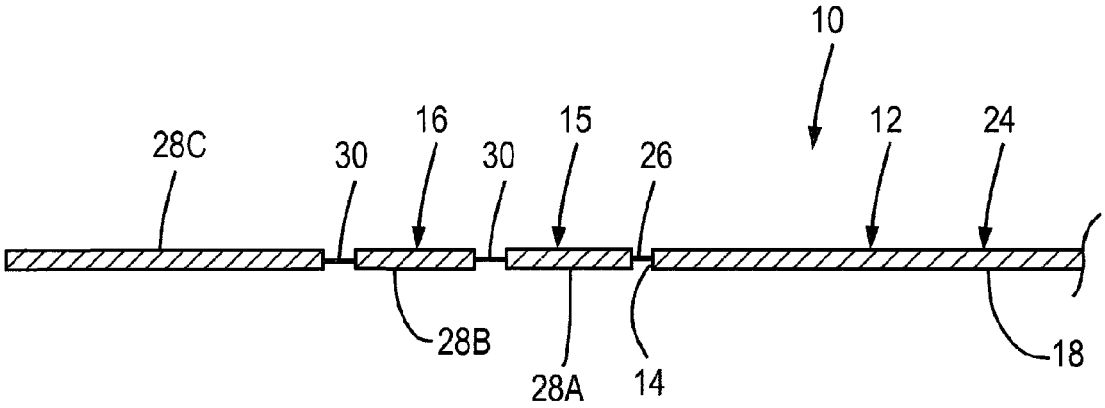
FIG. 9 is a close up cross sectional view of a rim arrangement of the fourth embodiment of the load capping arrangement shown in FIG. 8 with the rim arrangement in a non-deformed condition.
Figure 10:
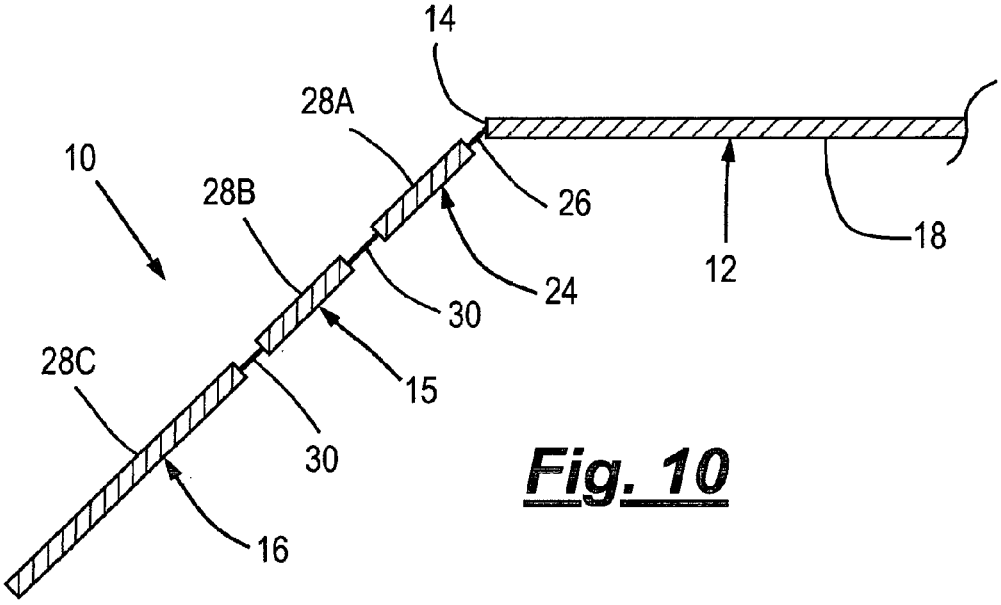
FIG. 10 is a close up cross sectional view of the rim arrangement of the fourth embodiment of the load capping arrangement shown in FIG. 8 with the rim arrangement in a deformed condition.

Each rim portion 16 is foldably deformed when a wrapping is applied, as described above between a non-deformed condition, shown in FIG. 9, in which the rim portion 16 extends substantially parallel to the central region 12 and a deformed condition, shown in FIG. 10, in which the rim portion 16 extends transverse to the central region 16.

Each rim portion 16 comprises a plurality of planar foldable members 28 foldably attached to one another by a plurality of second hinge lines 30, where each of the second hinge lines 30 is in the form of a live hinge.

The fourth embodiment provides the advantage that the load capping arrangement can be used with different sized loads. This is shown in FIGS. 11 and 12, in which the innermost foldable member is designated 28A, and the other foldable members are designated 28B, 28C and 28D respectively.

Figure 11:
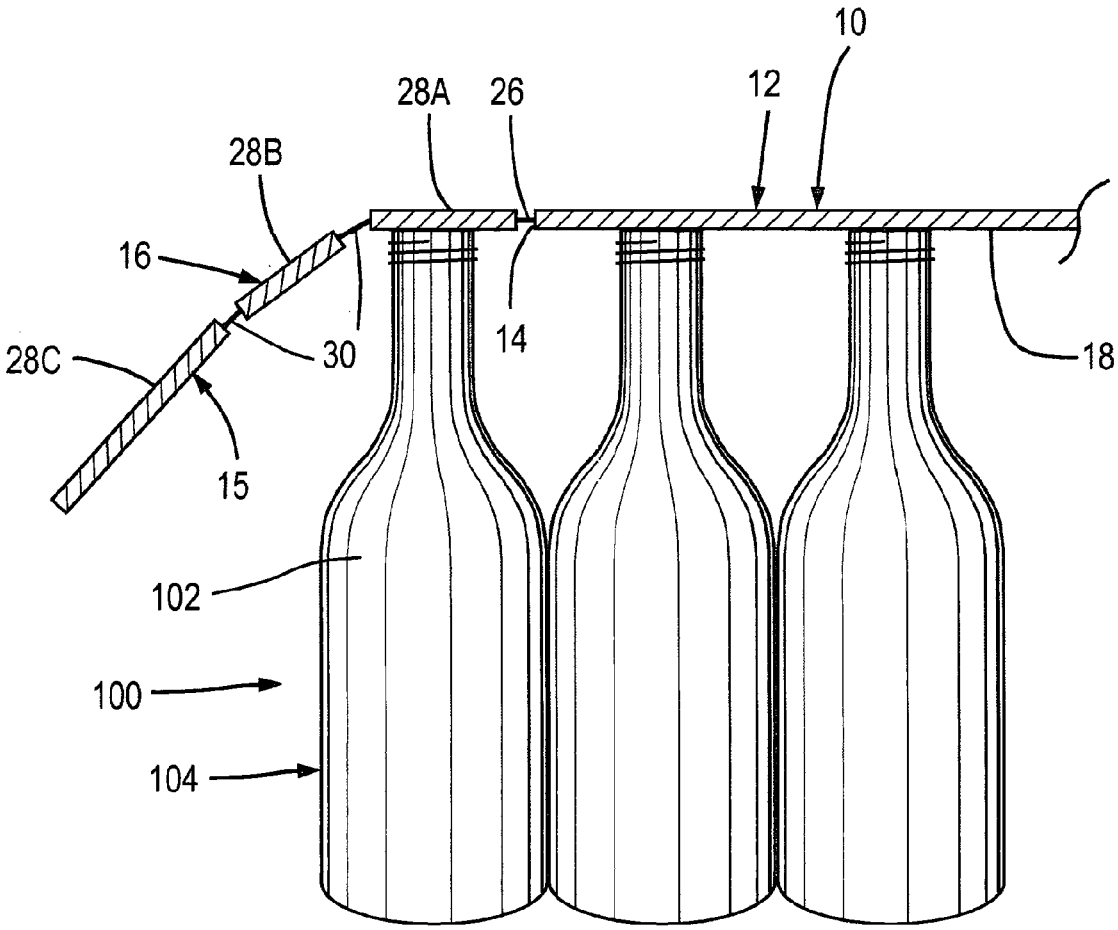
FIG. 11 is a close up cross sectional view of the rim arrangement of the fourth embodiment of the load capping arrangement shown in FIG. 8, with an inner foldable member of the load capping arrangement on an outer article.
Figure 12:
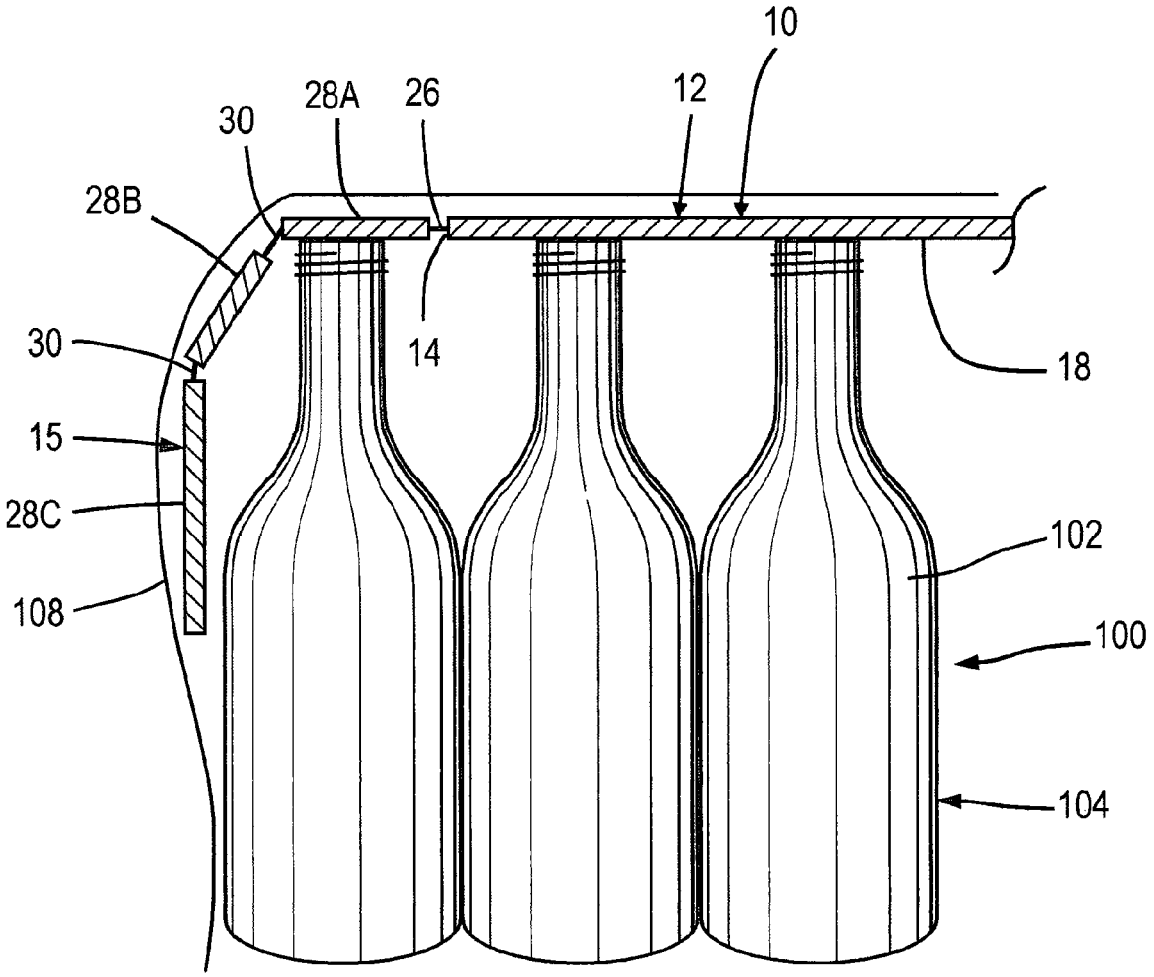
FIG. 12 is a view similar to FIG. 11, with the rim arrangement in the deformed condition having a wrapping applied thereto.

Thus, as shown in FIGS. 11 and 12, the innermost foldable member 28A in FIGS. 11 and 12, engages the top of the outermost bottle 102 when the load capping arrangement 10 is used on a larger load of bottles 102. With this arrangement, the other foldable members 28B, 28C and 28D are deformed downwardly over the bottles 102 we the wrapping 108 is applied.

A fifth embodiment is shown in FIGS. 13 to 20, in which the load capping arrangement 10 is formed of a plastic sheet 24 comprising the central region 12 and a plurality of the rim portions 16 extending outwardly from the peripheries 14 of the central region 12. Each rim portion 16 can be folded relative the central region 12 about a hinge line 126. The hinge line 126 may be a live hinge, such as present in the fourth embodiment. Alternatively, the hinge line 126 may be an imaginary line about which the rim portion 16 bends.

In the fifth embodiment, each rim portion 16 comprises a deformable region 40 which, in the embodiment shown, is in the form of an apertured region.

The deformable region 40 defines a plurality of apertures in the form of elongate slots 42. The slots 42 are arranged in rows extending parallel to the periphery 14 to which the respective rim portion 16 is attached.

Each deformable region 40 comprises a plurality of elongate members 44, each of which extends the length of the aperture region. Connecting members 46 extend between adjacent elongate members 44, whereby the slots 42 are defined between adjacent elongate members 44 and adjacent connecting members 46.

Figure 13:
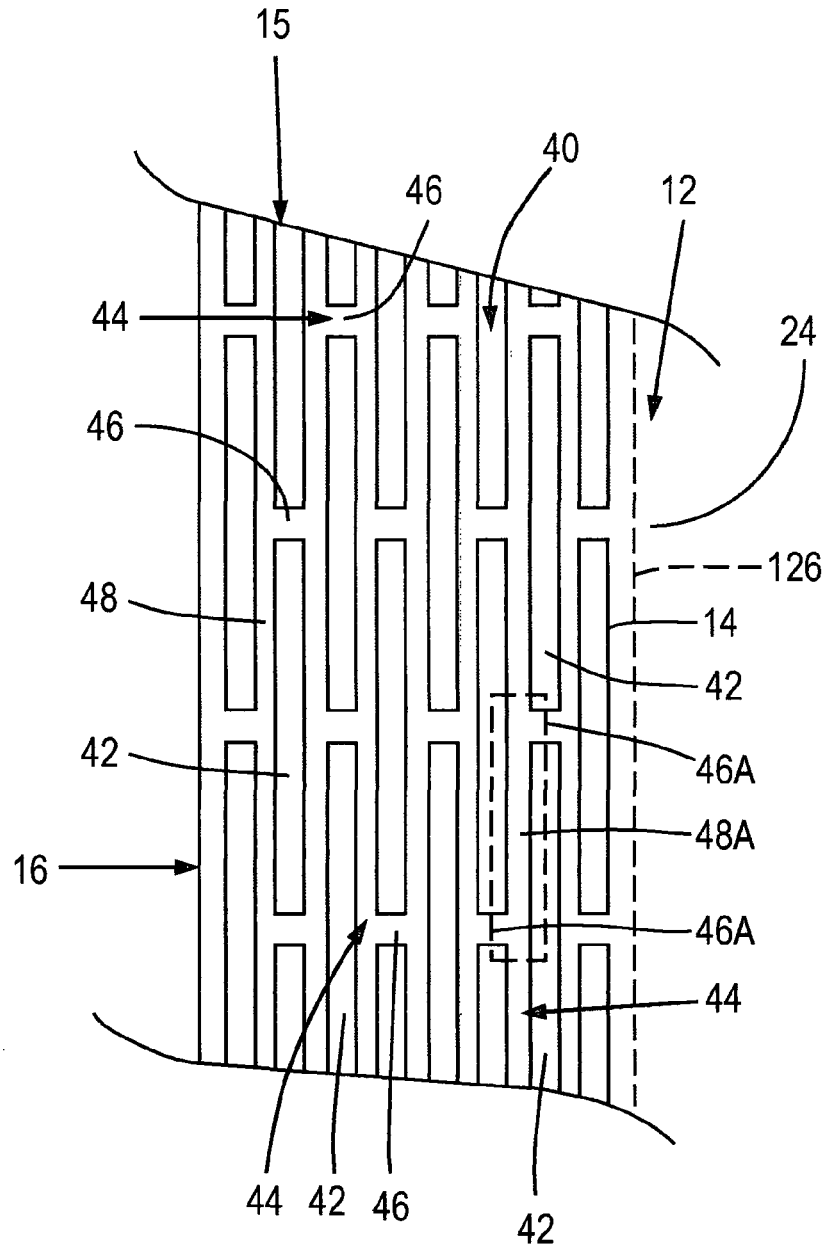
FIG. 13 is a close up of a region of a fifth embodiment of a load capping arrangement showing a rim arrangement and the central region.

Each elongate member is divided into a plurality of torsion bars 48, each torsion bar 48 extending between adjacent connecting members 46. For example, the torsion bar 48A shown in FIG. 13 is defined between the adjacent connecting members 46A. The torsion bar 48A is highlighted in FIG. 13 by the use of a rectangle drawn in a broken line. The torsion bars 48 are arranged in rows parallel to the rows of the slots 42.

The stiffness of the torsion bars 48 can be varied by varying the distance between adjacent connecting members 46.

The torsion bars 48 allow the rim portions 16 to deform from a non-deformed condition to one of a plurality of deformed conditions by bending, such bending occurring about the torsion bars 48. This has the advantage of reducing the stress on the material forming the rim portions, and helping to reduce permanent deformation. The bending of the rim portion 16 about a row of the torsion bars 48 causes the torsion bars 48 to twist about their longitudinal axes.

Figure 14:
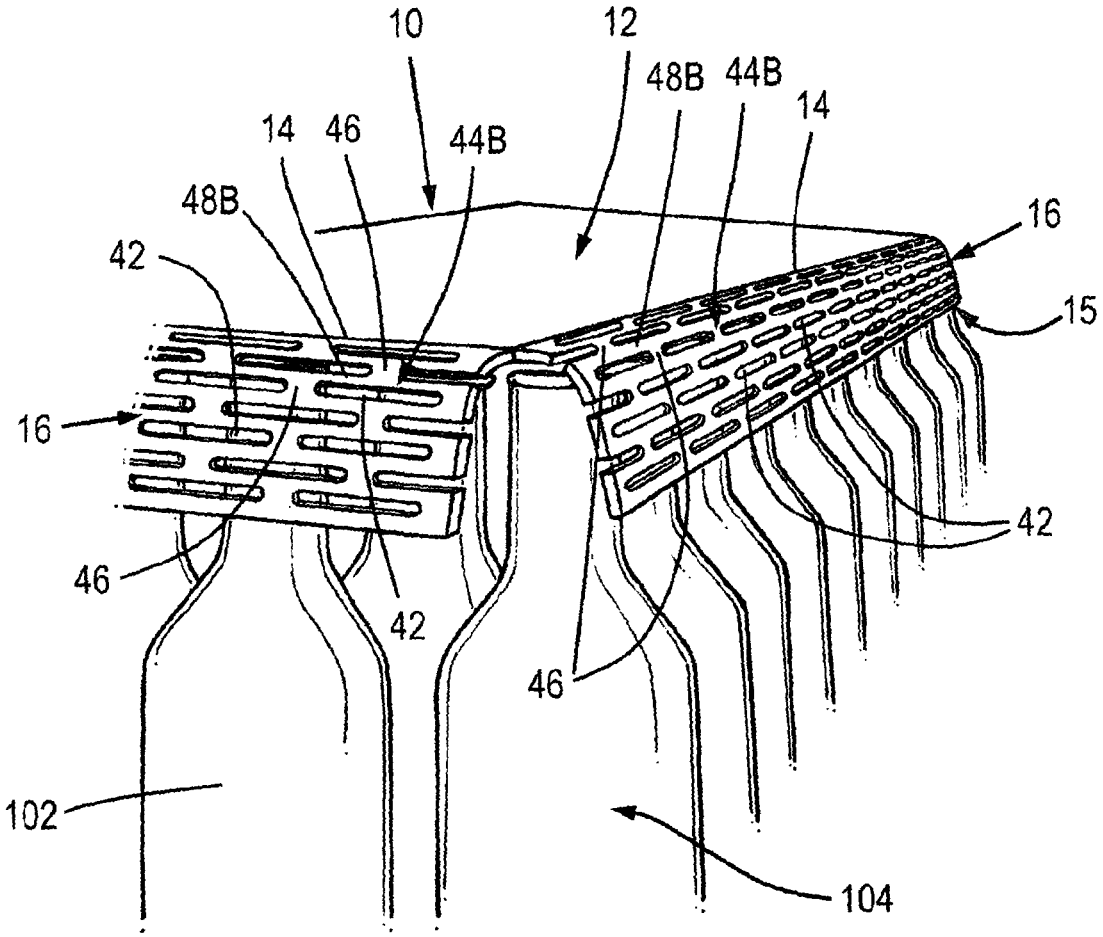
FIG. 14 shows a corner region of the fifth embodiment of the load capping arrangement mounted on a load.

FIG. 14 shows the fifth embodiment of the load capping arrangement 10 on a stack of bottles 102. The load capping arrangement 10 is disposed on the bottles 102 such that the tops of all the bottles are engaged by central region 12. When a wrapping (not shown in FIG. 14) is arranged around the bottles 102, the wrapping bends the rim portions 16 into the deformed condition shown in FIG. 14. The torsion bars 48 about which the rim portions 16 are bent are designated 48B in FIG. 14. The torsion bars designated 48B form the elongate members designated 44B in FIG. 14.

The bending of the rim portions 16, as shown in FIG. 14 transmits the force from the wrapping away from the bottles, thereby reducing the risk of breakage. Moreover, contact between the rim portions 16 and the bottles 102 increases the stability of the layer of bottles 102.

Figure 15:
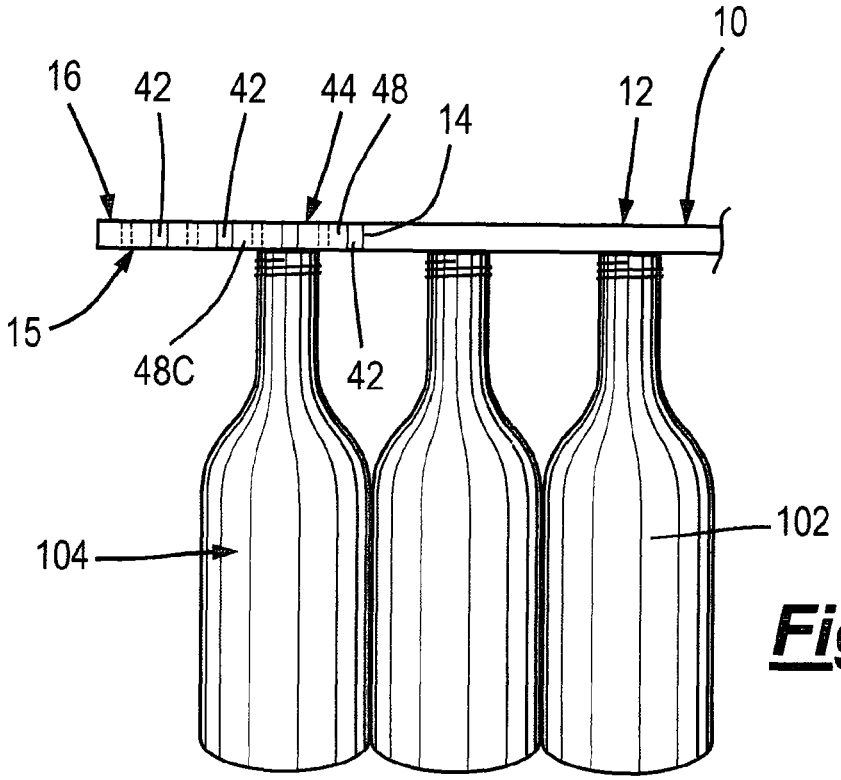
FIG. 15 is a close up cross sectional view of rim arrangement of the fifth embodiment, with the rim arrangement in the non-deformed condition.
Figure 16:
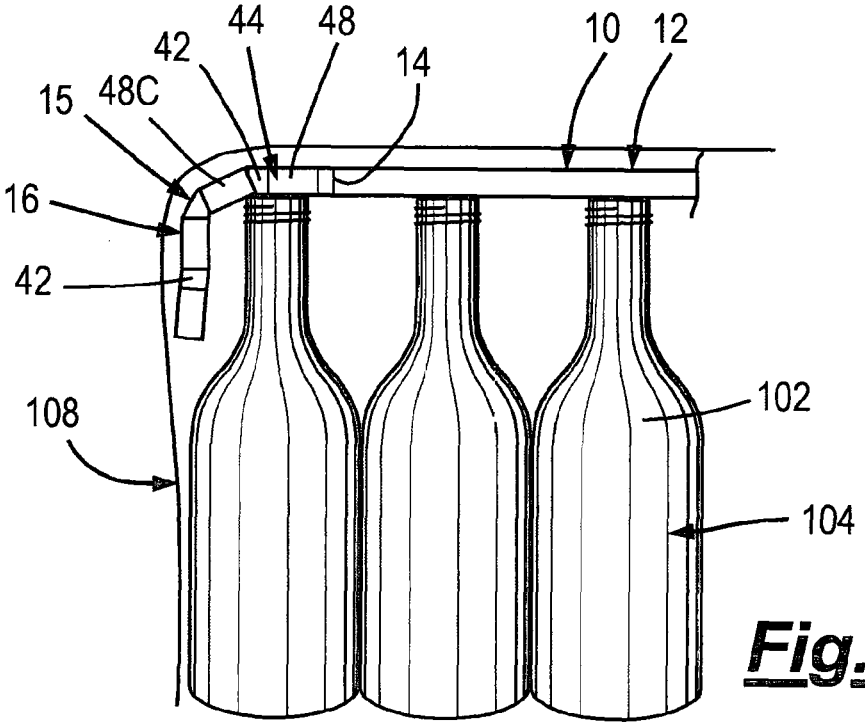
FIG. 16 is a view similar to FIG. 15 of the fifth embodiment of the load capping arrangement with a wrapping applied thereto with the rim arrangement in the deformed condition.

FIGS. 15 and 16 show a further arrangement, in which the outermost bottles 102 are spaced from the peripheries 14 and engaged by the rim portions 16. FIG. 15 shows the rim portion 16 in the non-deformed condition. FIG. 16 shows the rim portion 16 bent by the wrapping 108 to one of the deformed conditions. With this arrangement, the torsion bars 48 about which the rim portions 16 are bent are designated 48C in FIGS. 15 and 16.

Figure 17:
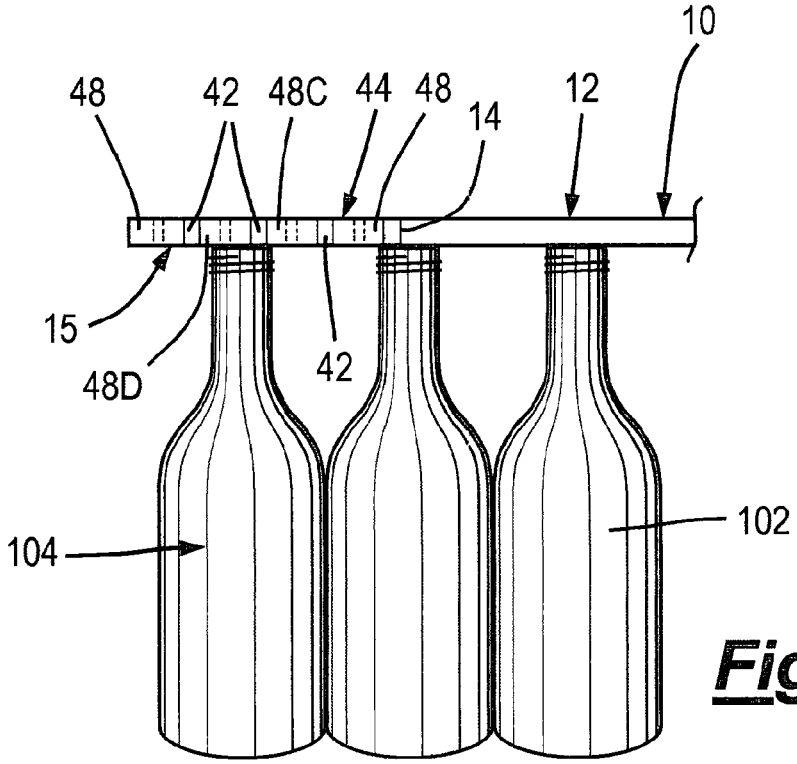
FIG. 17 is a close up cross sectional view of the rim arrangement of the fifth embodiment, with the rim arrangement in a non-deformed condition.
Figure 18:
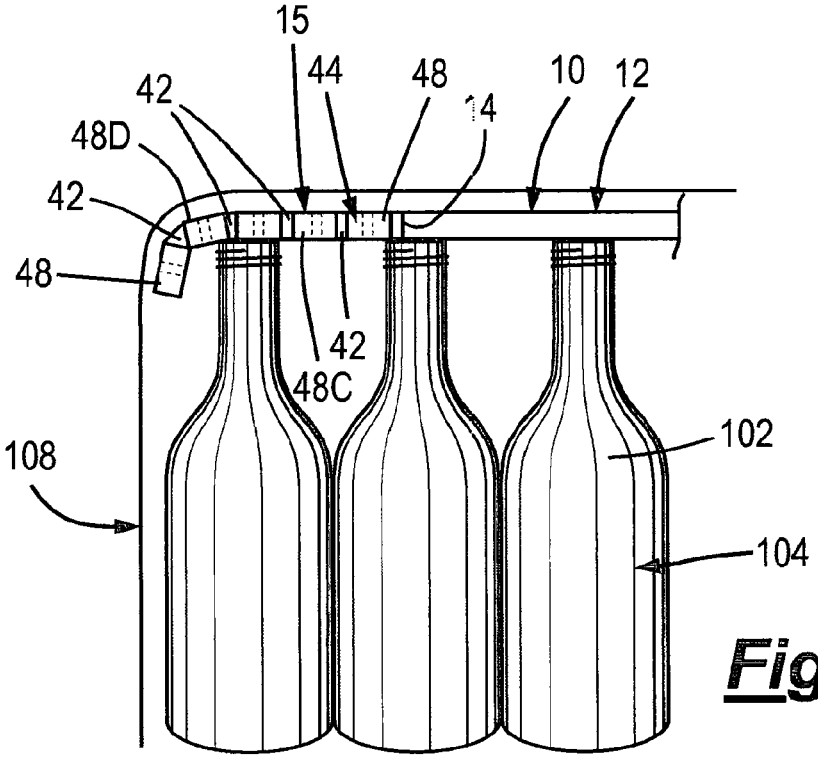
FIG. 18 is a view similar to FIG. 17, with the rim arrangement in the deformed condition around an outer article of the load, the load capping arrangement and the load having a wrapping applied thereto.
Figure 19:
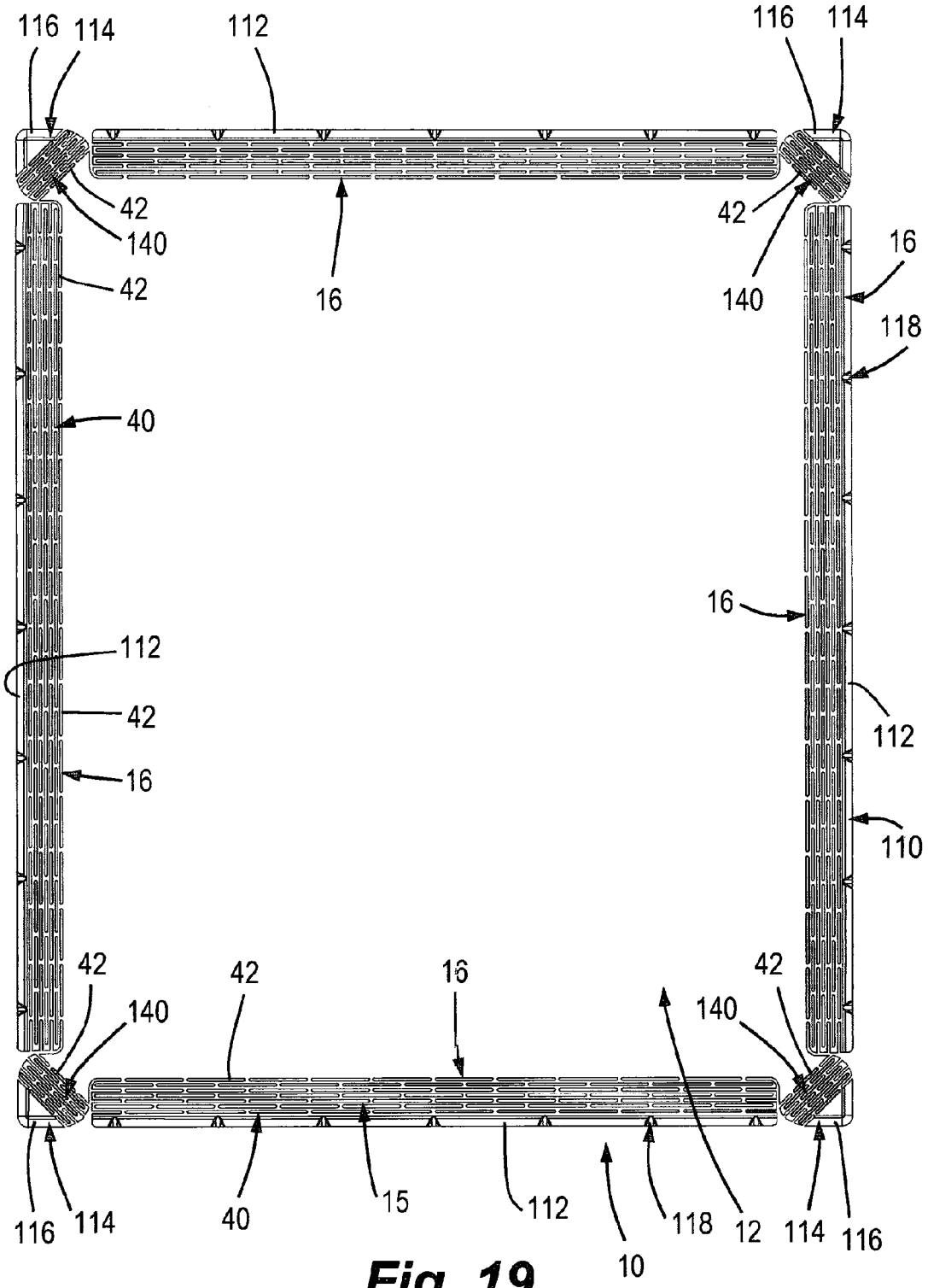
FIG. 19 is a bottom plan view of a sixth embodiment.

In FIGS. 17 and 18 another arrangement is shown, which is similar to the arrangement shown in FIGS. 15 and 16. In FIGS. 17 and 18, the outermost bottles 102 are disposed further from the peripheries 14 of the central region 12 than the outermost bottles 102 shown in FIGS. 15 and 16. FIG. 17 shows the rim portion 16 in the non-deformed condition. The rim portion 16 is bent to another of the deformed conditions by the wrapping 108 about the torsion bars designated 44D in FIGS. 17 and 18.

A comparison of FIGS. 15 and 16 with FIGS. 17 and 18 shows that the load capping arrangement 10 can be used with different size stacks of bottles 102, by bending the rim portions 16 along different lines to a desired one of a plurality of deformed conditions.

There are thus described various embodiments of a load capping arrangement 10 which have the advantage that when disposed upon the top of an upper layer 104 of bottles 102 stacked on a pallet, all the bottles 102 in the upper layer 104 are stabilised, thereby allowing the pallet to be moved without the bottles 102 falling off. A further advantage is that each of the embodiments has a rim portion 16 which allows the pallet to be wrapped in a wrapping, such as a shroud without displacing any of the bottles 102 in the upper layer 104.

Figure 8:
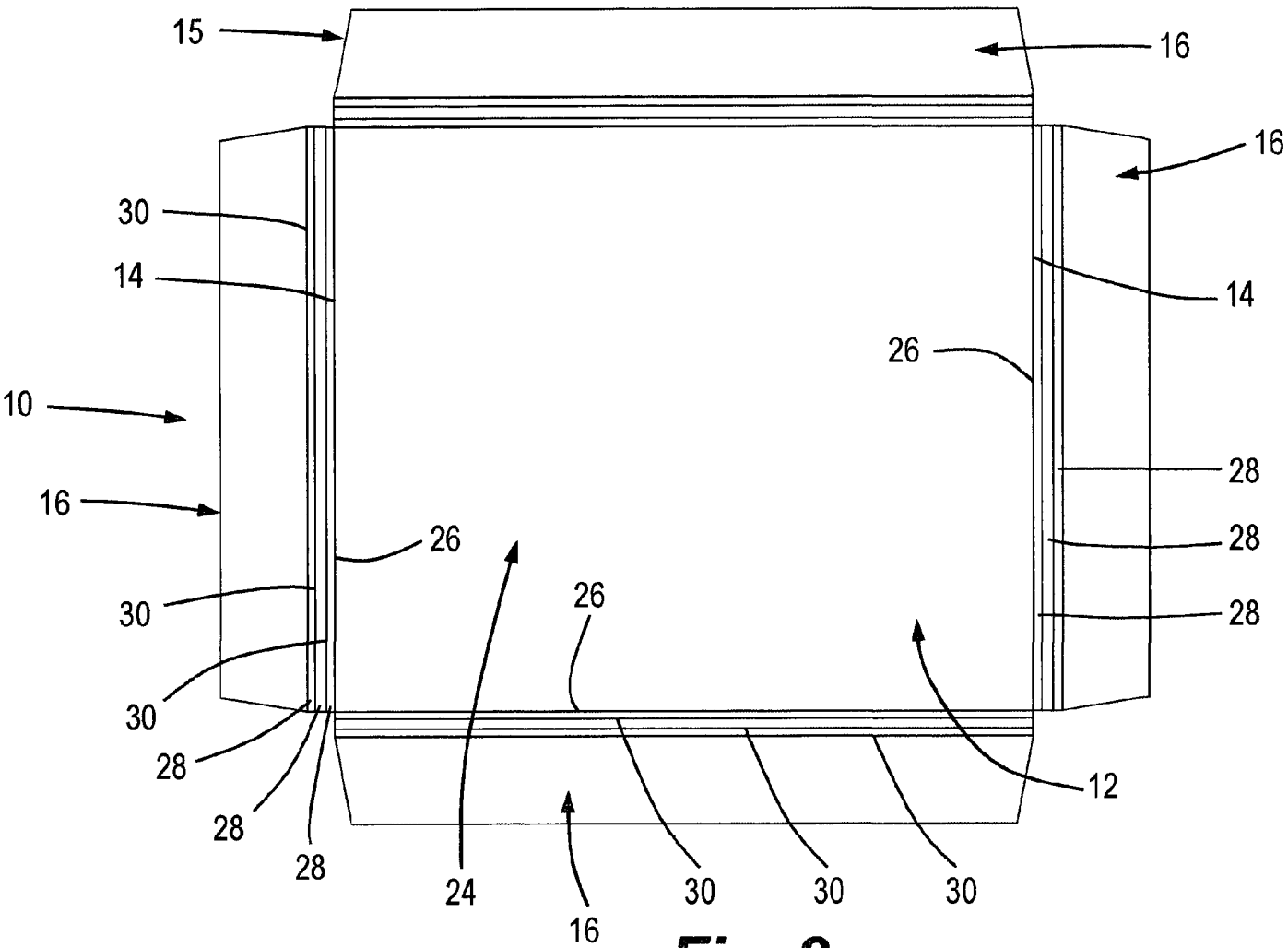
FIG. 8 is a top plan view of the fourth embodiment of the load capping arrangement.

Various modifications can be made without departing from the scope of the invention. For example, the load capping arrangement could be any other suitable configuration, other than rectangular to correspond with the configuration of the load. Also the number of foldable members 28 in the fourth embodiment shown in FIGS. 7 to 12 can vary. FIG. 8 shows four foldable members 28, whereas FIGS. 9 to 12 show three foldable members 28A, 28B, 28C.

In a further modification, one or more of the live hinges can be replaced by mechanical hinges.

A sixth embodiment is shown in FIGS. 19 to 25, which comprises many of the features of the fifth embodiment shown in FIGS. 13 to 18. These features have been designated with the same reference numerals as the corresponding features in FIGS. 13 to 18.

The sixth embodiment of the load capping arrangement 10 differs from the fifth embodiment in that the load capping arrangement 10 further includes a lip arrangement 110 extending from the rim arrangement 15. The lip arrangement 110 may comprise a plurality of side lip members 112, each extending outwardly from a respective one of the rim portions 16.

Figure 22:
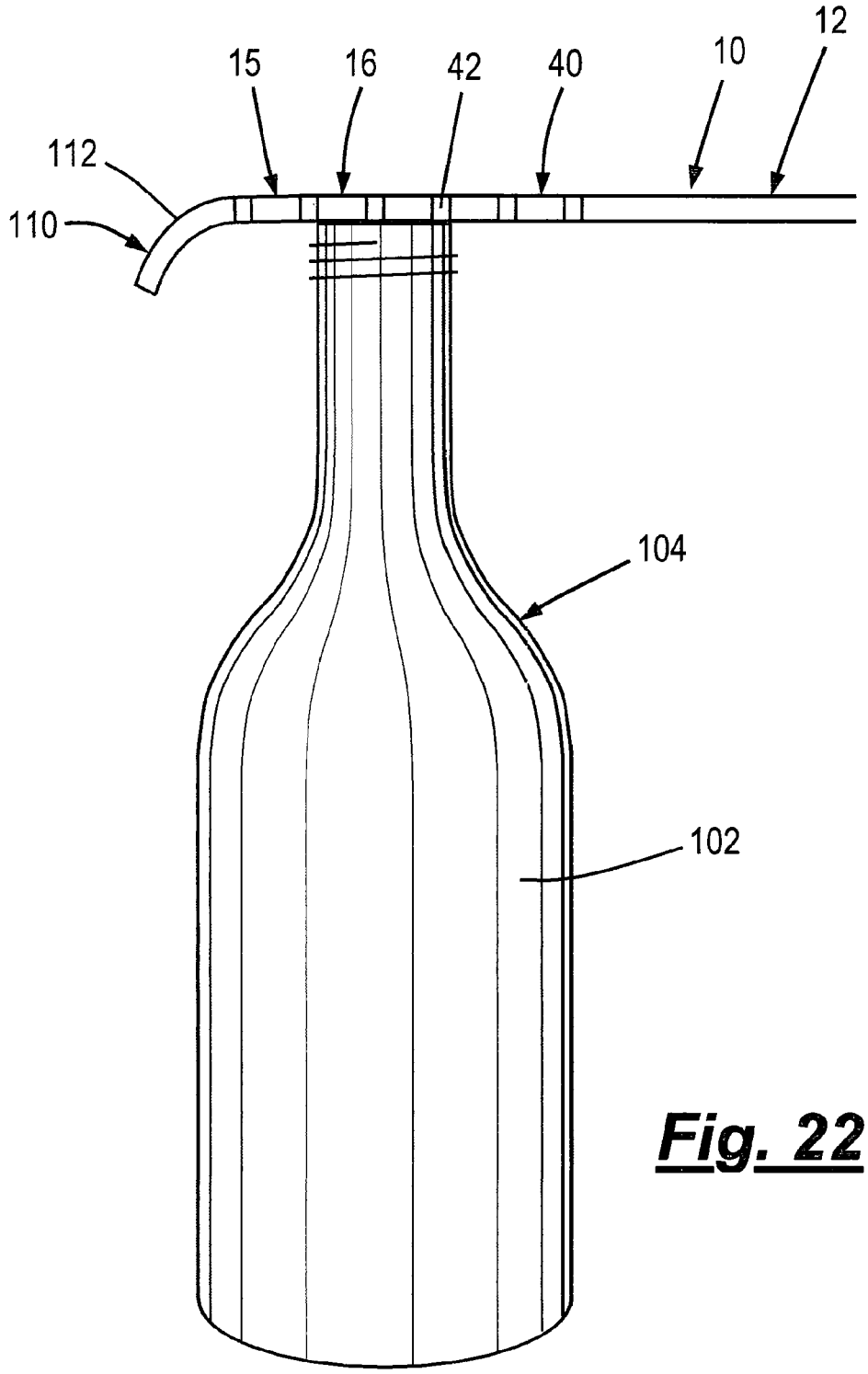
FIG. 22 is a close up sectional view showing a lip arrangement of the sixth embodiment.

Referring to FIG. 22, each side lip member 112 curves downwardly away from the rim portion 16 to which it is attached. Alternatively, each side lip member 112 could curve upwardly from the rim portion 16. In a further embodiment, the plurality of side lip members 112 curve alternately upwardly and downwardly away from the rim portion 16.

FIG. 22 shows a sectional side view of a rim portion 16 and the side lip member 112 attached thereto, in which the downward curvature of the side lip member 112 is shown.

Figure 20:
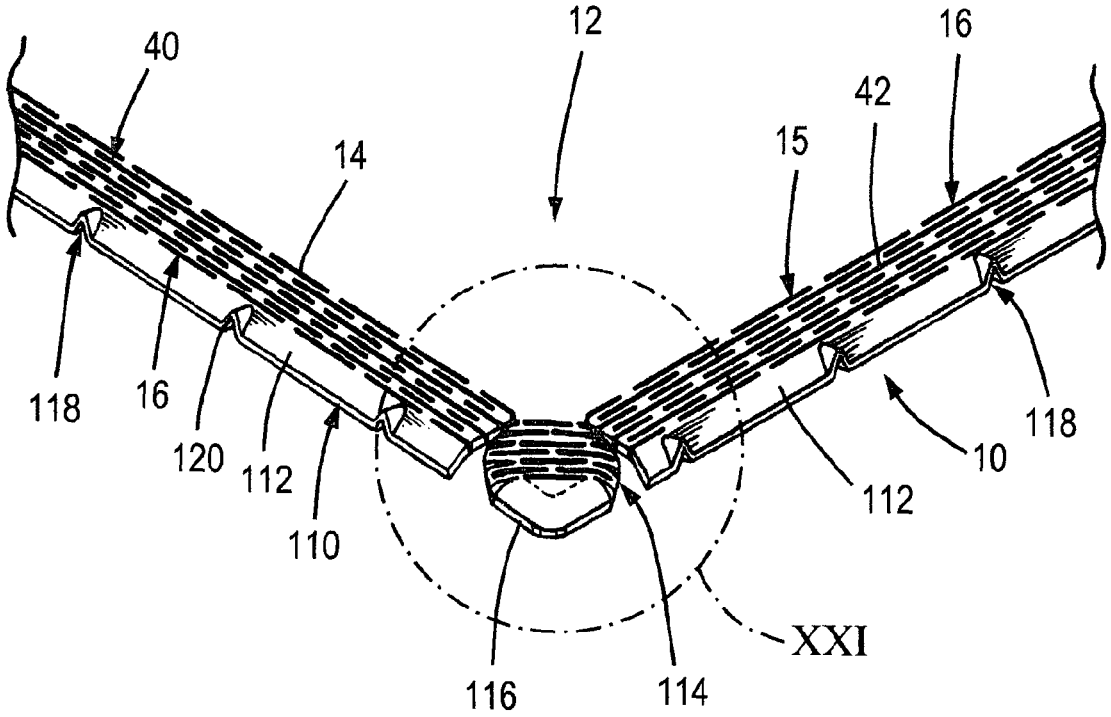
FIG. 20 is a perspective view from above of a corner region of the sixth embodiment shown in FIG. 19.
Figure 21:
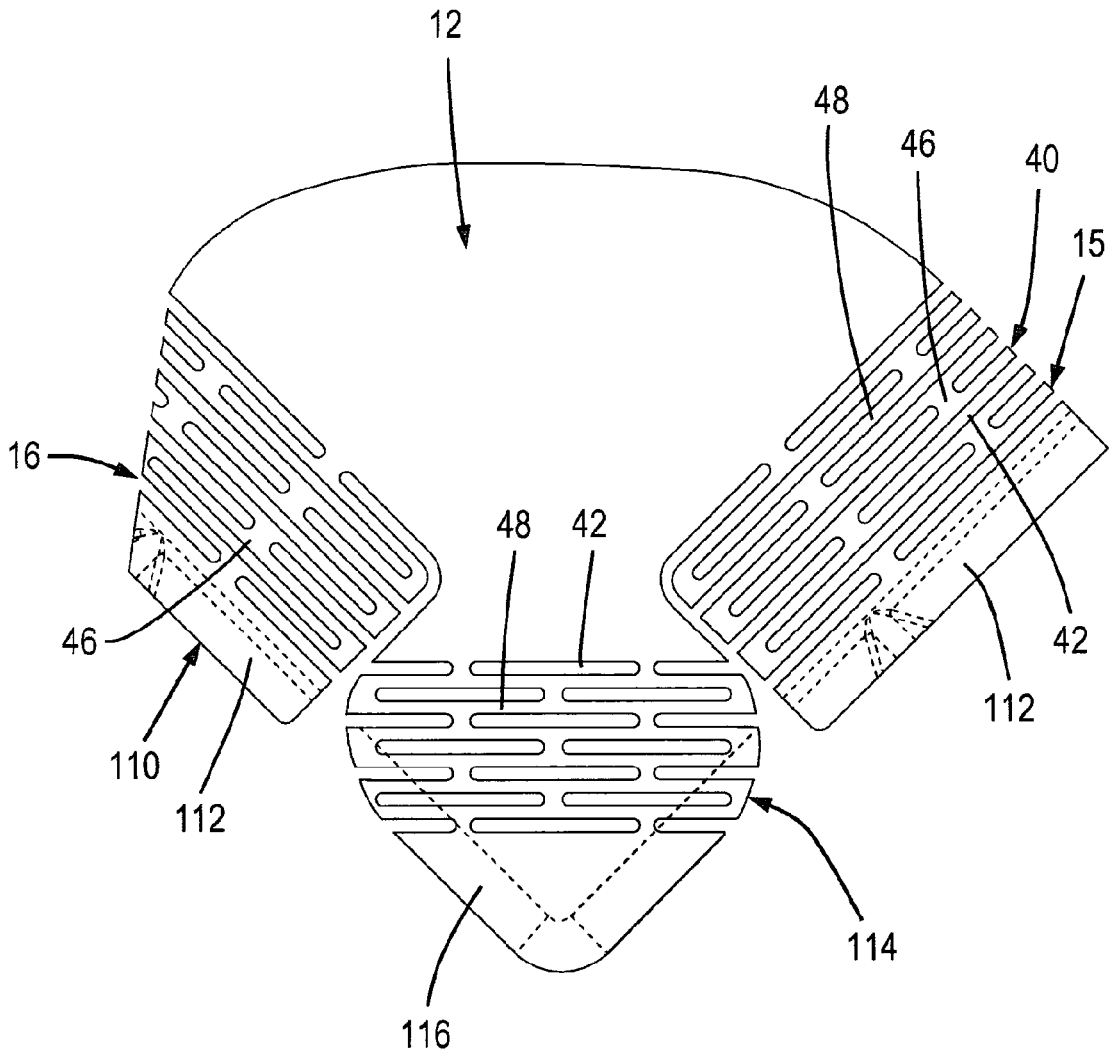
FIG. 21 is a top plan close up view of the region marked XXI in FIG. 20.

The rim arrangement 15 of the sixth embodiment of the load capping arrangement 10 further includes corner portions 114 at the corner regions between adjacent rim portions 16, shown in FIG. 20. The lip arrangement 110 further includes a plurality of corner lip members 116, a respective one of which is provided on each of the corner portions 114 and curves downwardly therefrom.

The provision of the side lip members 112 and the corner portions 114 provides the advantage in the embodiment shown that they retain the bottles 102 at the peripheries and corners of the load. These bottles 102 can be unstable, and the side lip members 112 and the corner portions 114 stabilise these bottles. As can be seen from FIG. 19, each of the corner portions 114 comprises a corner deformable region 140, in which, the apertures 42 extend diagonally relative to the apertures 42 in the deformable regions 40 of the rim portions 16.

Figure 23:
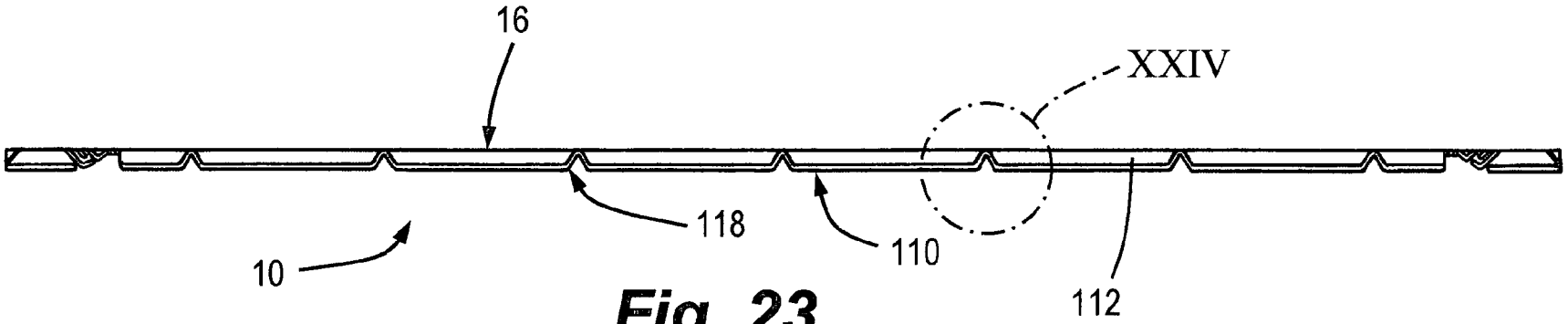
FIG. 23 is an edge view of the sixth embodiment, showing a centring structure on the lip arrangement.
Figure 24:
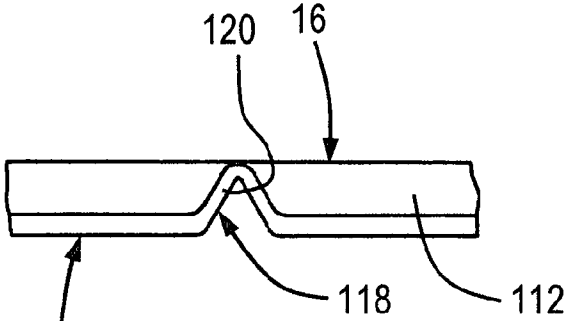
FIG. 24 is a close up view of the region marked XXIV in FIG. 23.

Referring to FIGS. 23 and 24, each of the side lip members 112 includes a plurality of centring structures 118, each of which has an outwardly facing engagement surface 120, which is of an inverted V shape. The engagement surfaces 120 may extend substantially at right angles to the central region 12.

In use, when the load capping arrangement 10 is disposed on a load, the engagement surfaces 120 extend substantially vertically, thereby presenting a vertical face outwardly.

Figure 25:
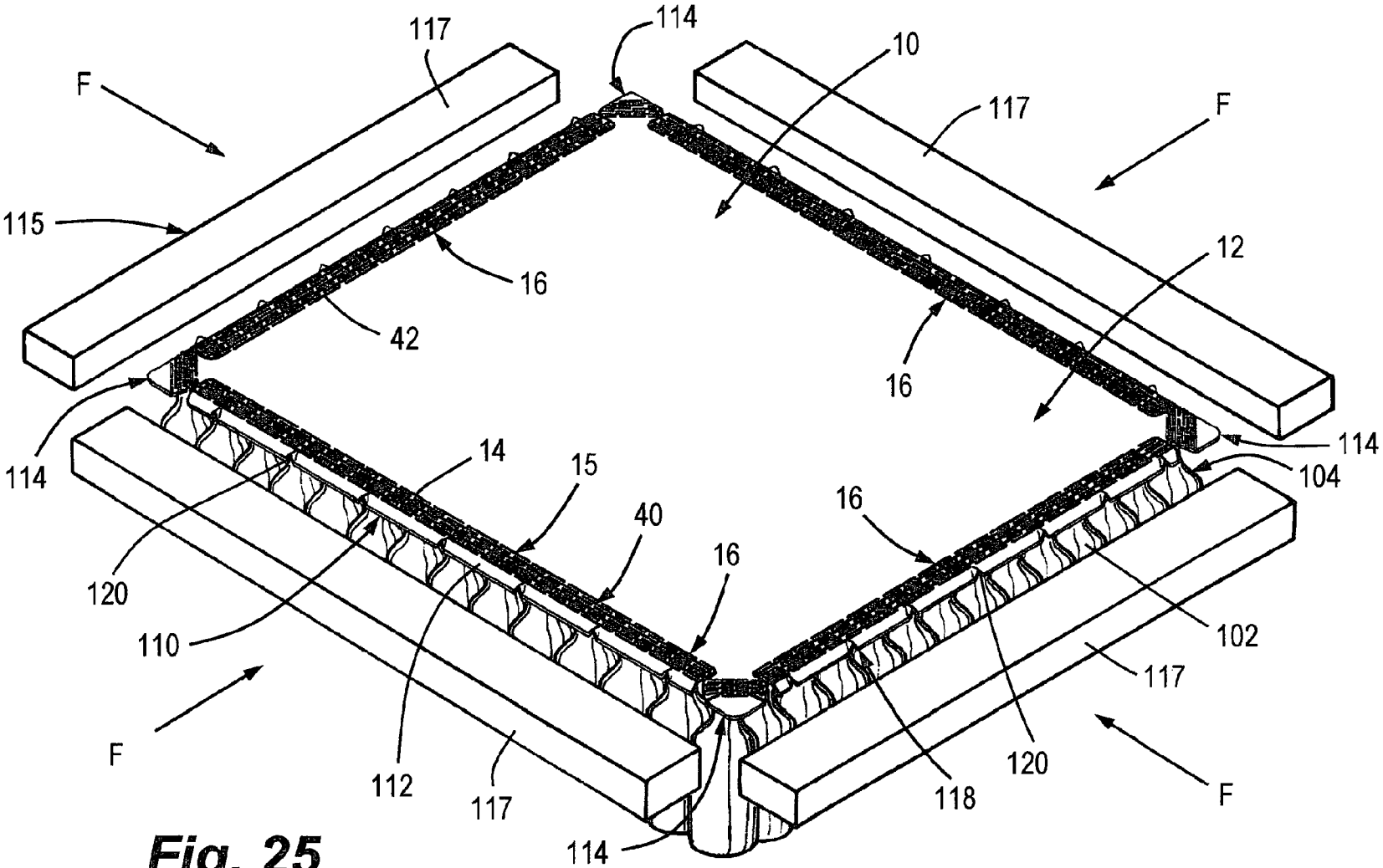
FIG. 25 shows a force applying means applying a force to the centring structure.

Referring to FIG. 25, a suitable centring apparatus 115 is provided for centring the load capping arrangement 10 on the load. The centring apparatus 115 comprises a manipulating apparatus having a plurality of force applying members in the form of buffers 117. In the embodiment shown, the centring apparatus 115 comprise four buffers 117.

One or more of the buffers 117 engages the engagement faces 120 along a respective one of the side lip members 112, and applies a force F to the load capping arrangement 10 to push the load capping arrangement 10 into a central position on the load, before wrapping 108 is applied.

In yet another modification, the deformable region 40 is in the form of a recessed region comprising a plurality of recesses. The recesses are elongate and include a membrane extending across each recess.

Further embodiments are shown in FIGS. 26 to 32, which comprise many of the features of the above described embodiments. These features have been designated with the same reference numerals the corresponding features in FIGS. 1 to 25.

Figure 26:
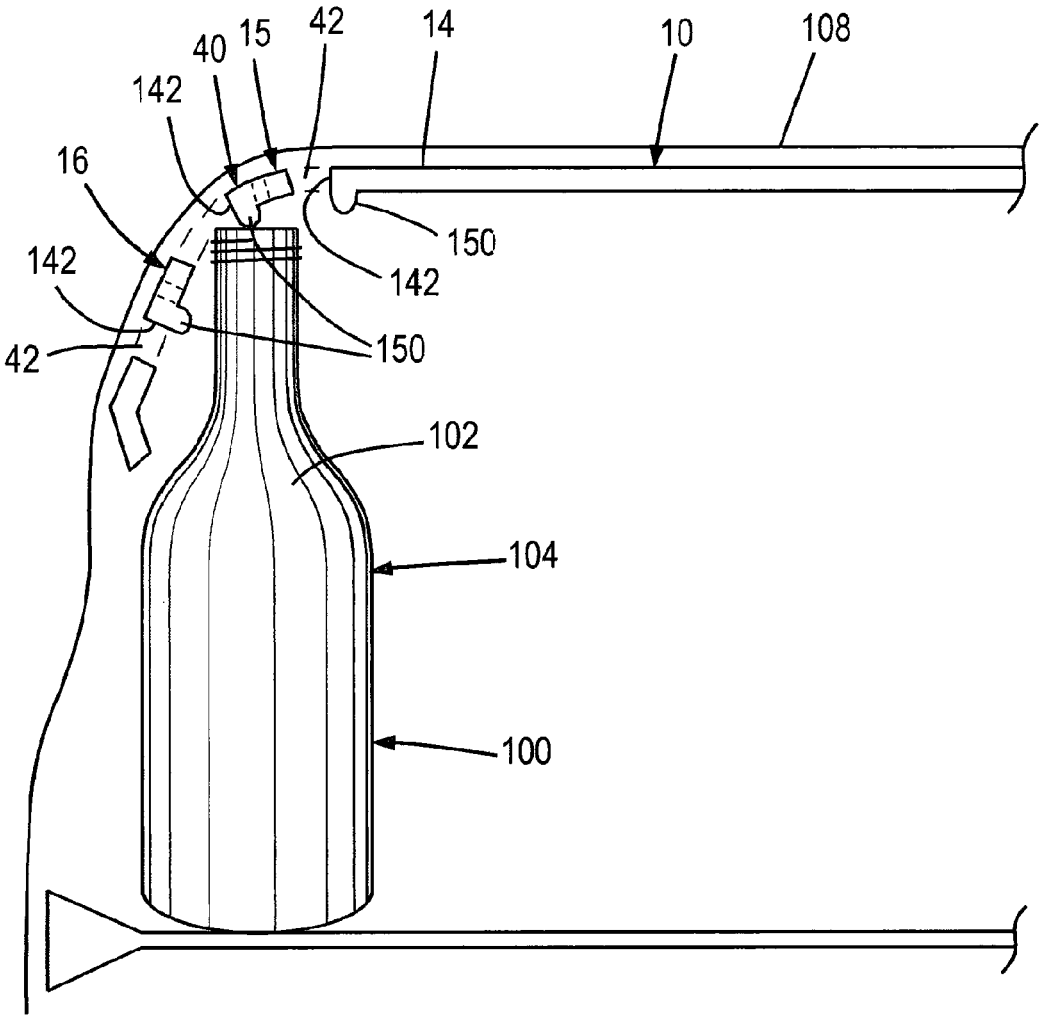
FIG. 26 is a close up cross sectional view of the rim arrangement of the seventh embodiment, with the rim arrangement in the deformed condition around an outer article of the load.

FIG. 26 shows a seventh embodiment of the load capping arrangement 10, in which the deformable region 40 includes a plurality of downwardly extending projections 150 provided to engage the outermost bottles 102 of the load 100. In one embodiment, the elongate apertures 42 have edges 142, and the projections 150 are provided on the innermost edge 142 of each of the apertures 42.

The projections 150 are provided along the edges 142 of the apertures 42 closest to the periphery 14 of the central region 12. The projections 150 are configured to hold the outermost bottles 102. Each of the outermost bottles 12 is engaged by two projections 150.

Figure 27:
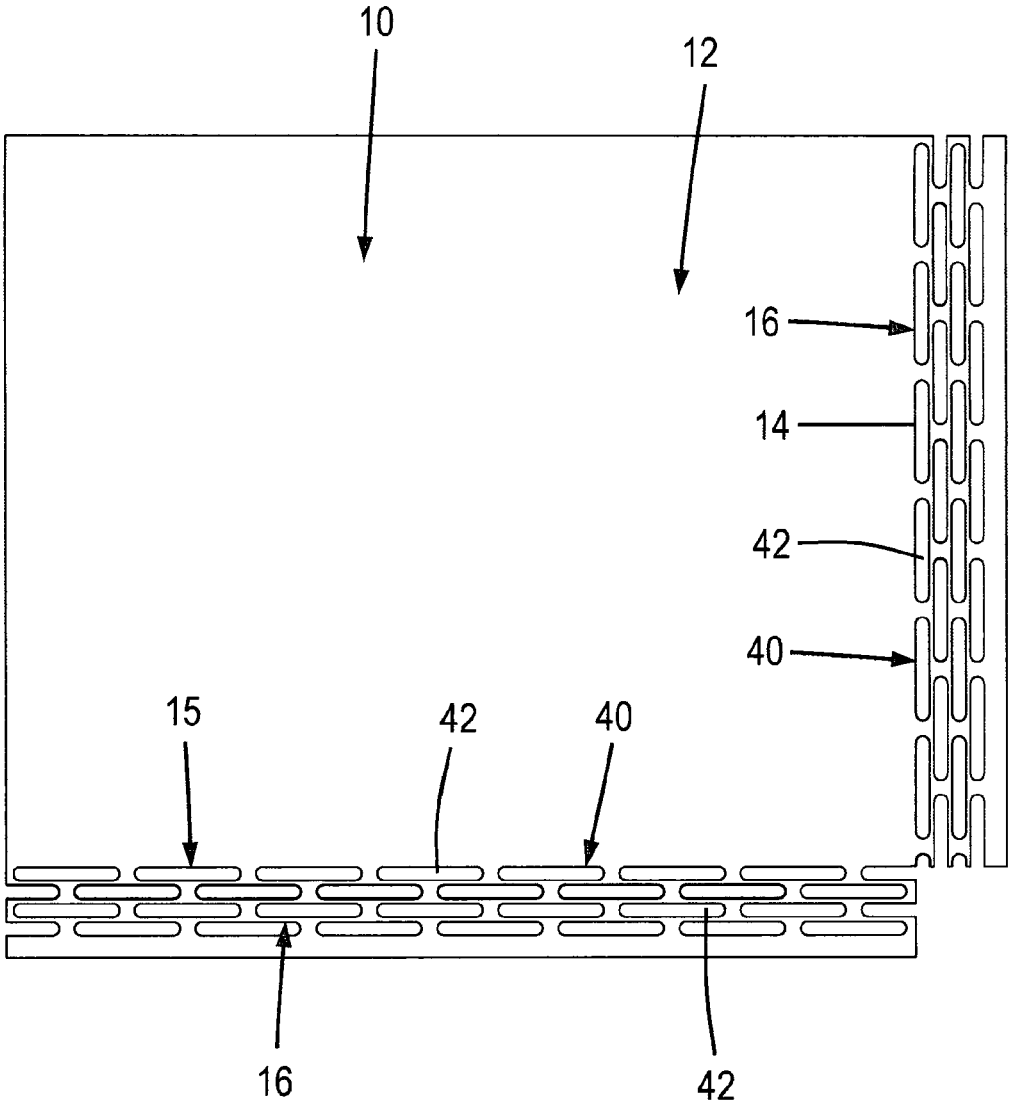
FIG. 27 is a top plan view of a region of an eighth embodiment, showing a portion of the rim arrangement.
Figure 28:
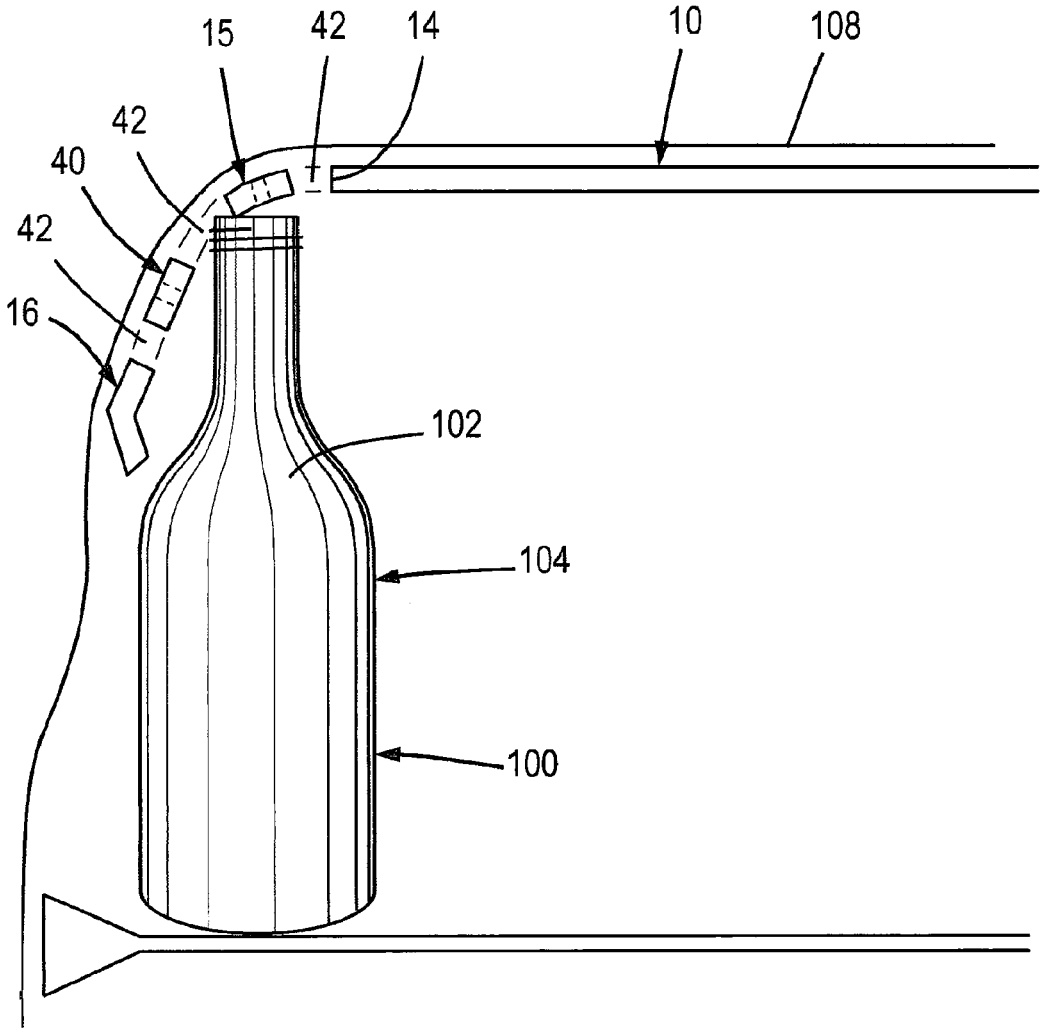
FIG. 28 is a close up cross sectional view of the rim arrangement of the eighth embodiment, with the rim arrangement in the deformed condition around an outer article of the load.

In an eighth embodiment, shown in FIGS. 27 and 28, the apertures 42 are configured to receive portions of the outermost bottles 102. In this embodiment, the apertures 42 are wider than the apertures 42 of the embodiments shown in FIGS. 13 to 26, and can receive portions of the outermost bottles 102 therein, as shown in FIG. 28. The apertures 42 of the eighth embodiment are, thus, configured to hold the outermost bottles 102.

Figure 29:
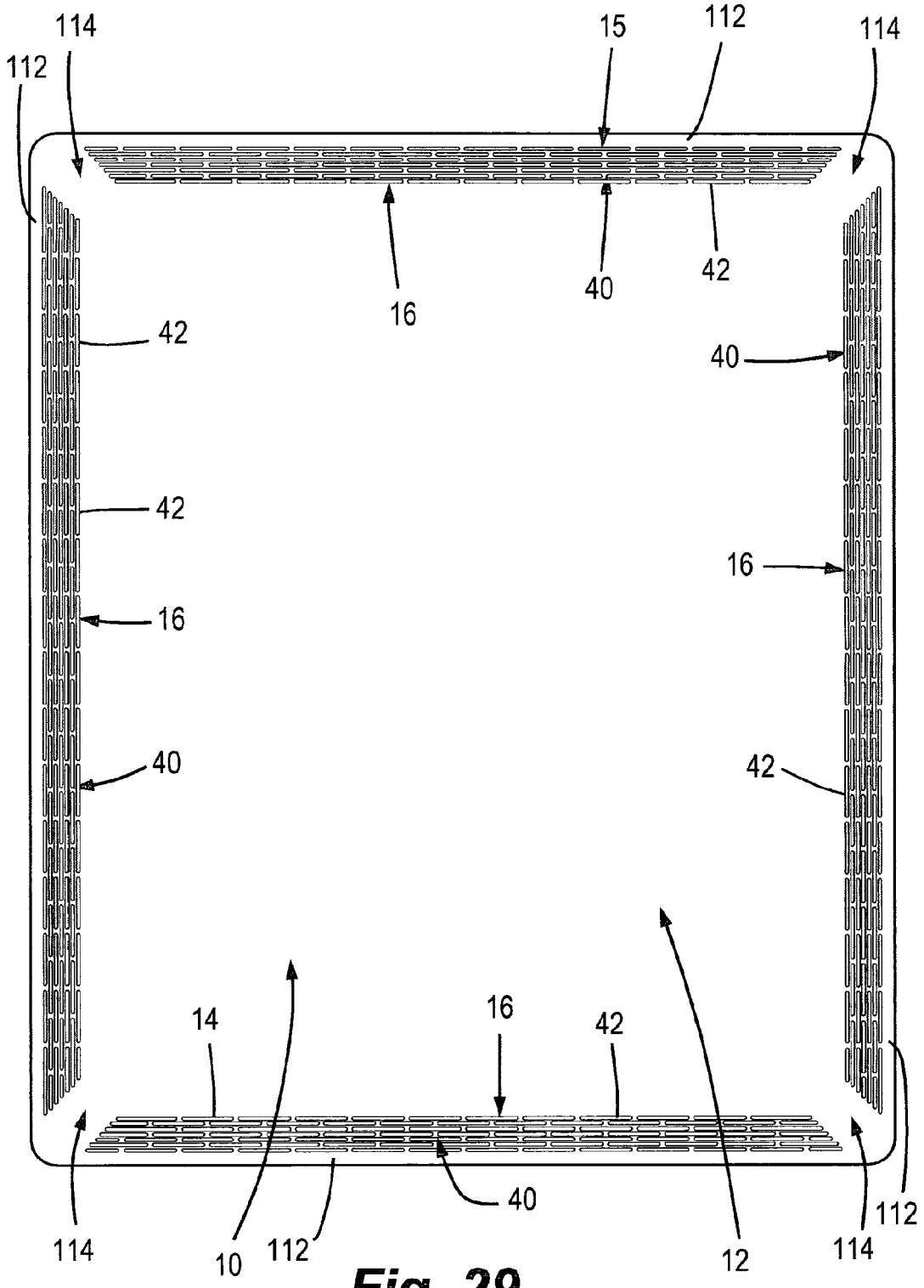
FIG. 29 is a top plan view of a ninth embodiment of the load capping arrangement.
Figure 30:
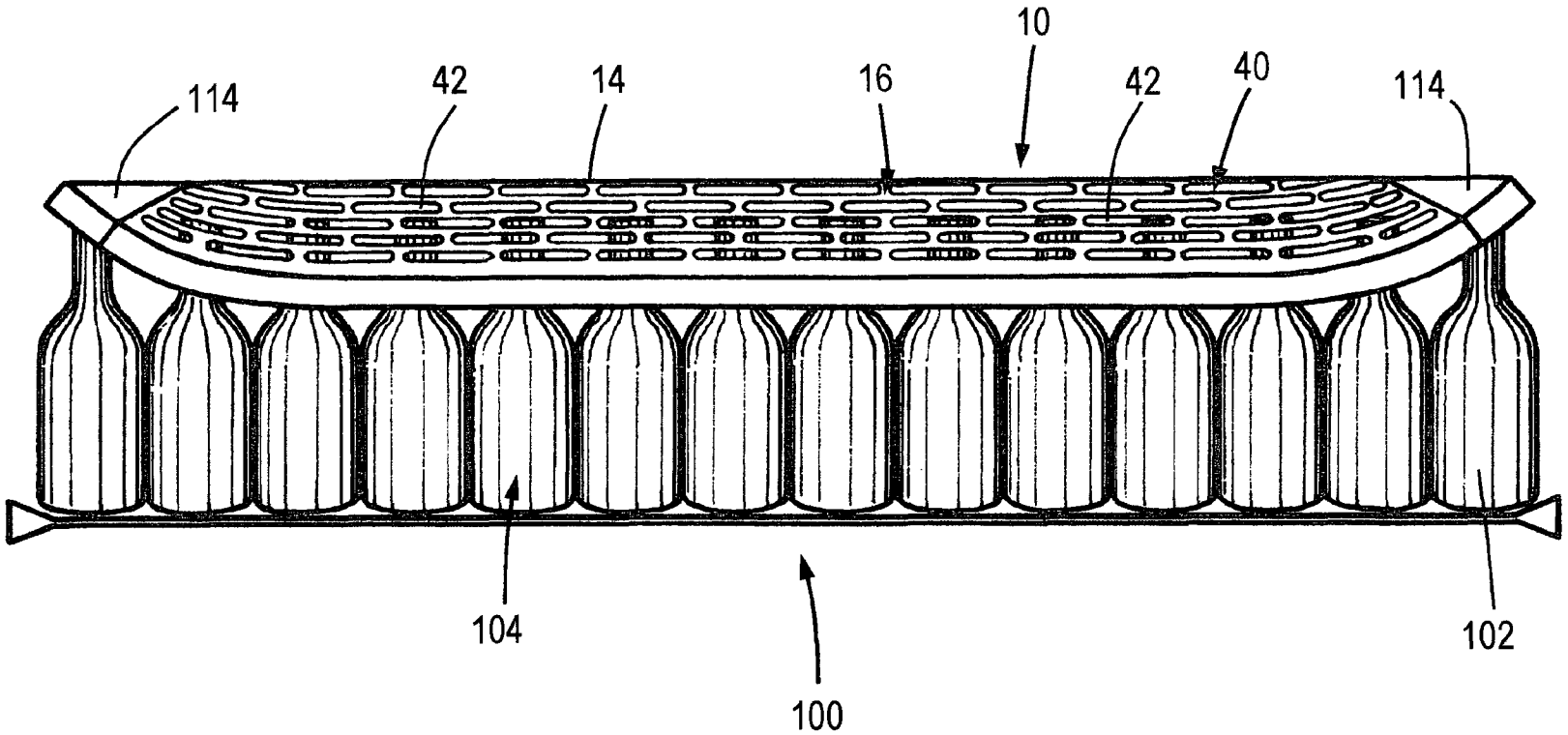
FIG. 30 is a side view of the ninth embodiment of the load capping arrangement on a load.

In a ninth embodiment, shown in FIGS. 29 and 30, the corner portions 114 are substantially devoid of the apertures 42, being formed substantially wholly of the material from which the remainder of the load capping arrangement 10 is formed. With this embodiment, as shown in FIG. 30, the corner portions 114 remain in a non-deformed condition as the rim portions 16 deform to the deformed condition about the bottles 102. The lack of the apertures 42 in the corner portions 114 provides the advantage in this embodiment that flexibility is reduced at the corner portions 114 thereby preventing the corner portions curving upwardly. This provides the benefit that the load 100 can be passed through a washing apparatus with a capping arrangement 10 thereon.

Figure 31:
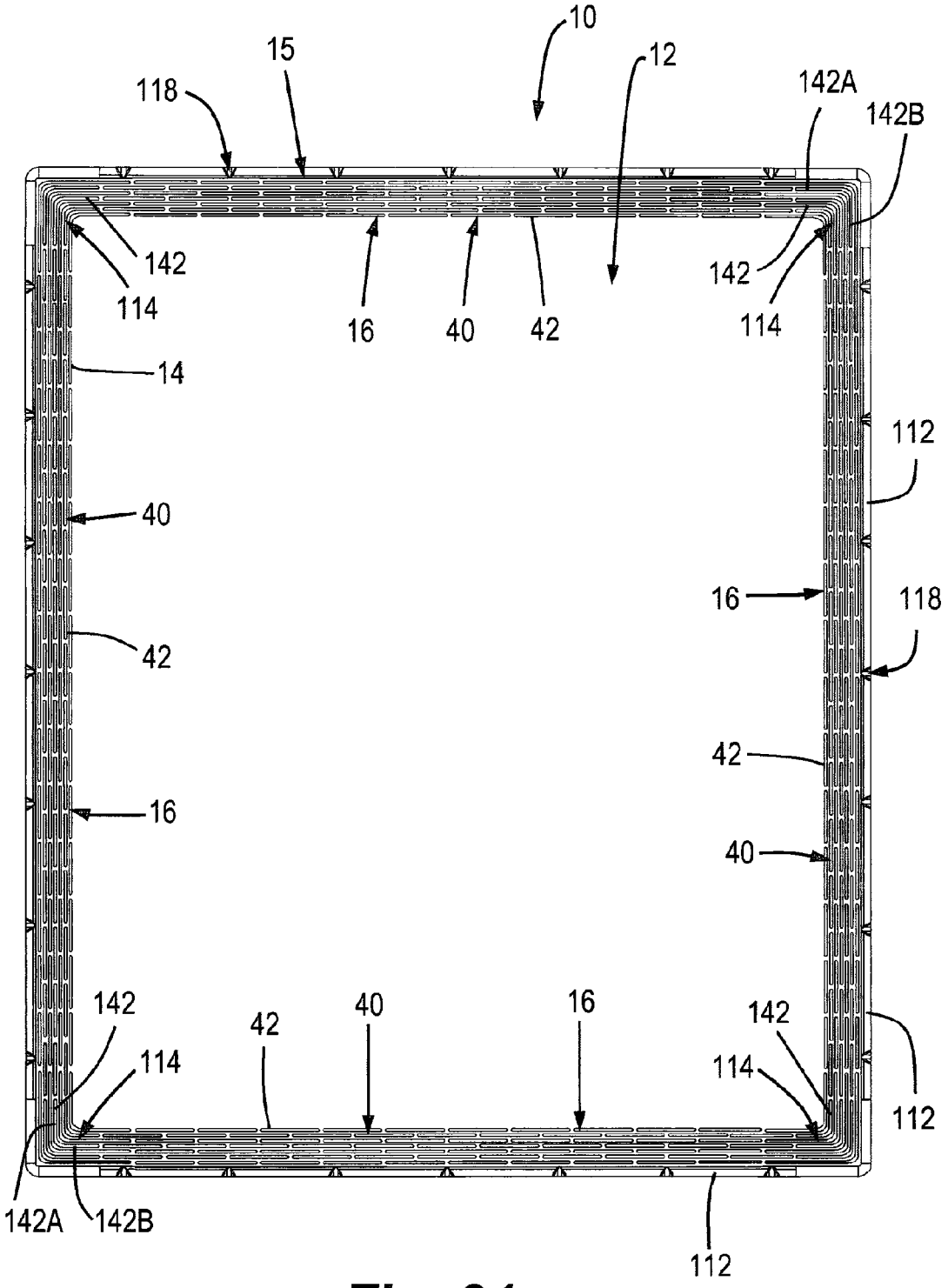
FIG. 31 is a top plan view of a tenth embodiment of the load capping arrangement.
Figure 31A:
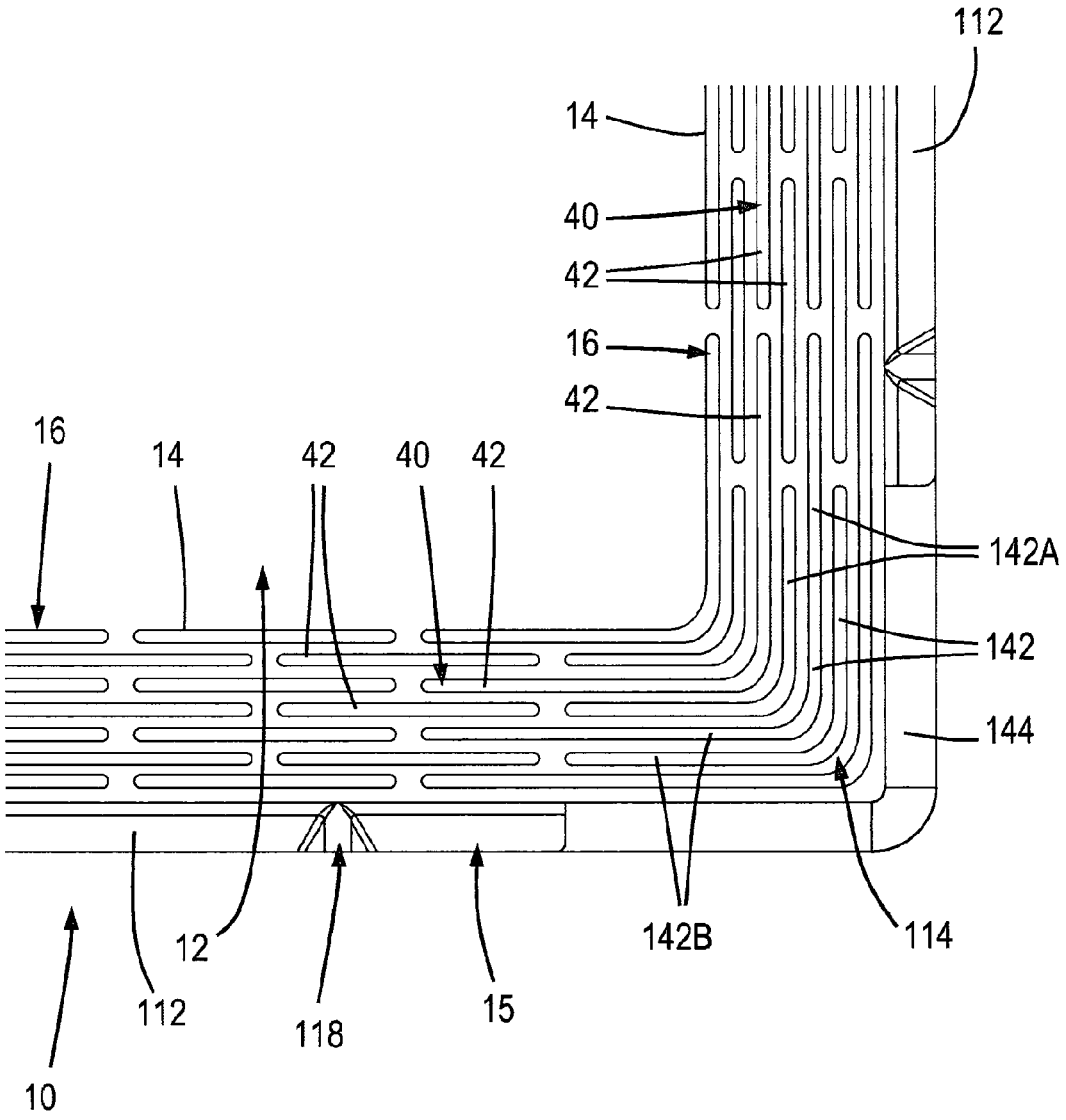
FIG. 31A is a close up view of a corner portion of the load capping arrangement shown in FIG. 31.

In a further embodiment shown in FIGS. 31 and 31A, each corner portion 114 defines elongate corner apertures 142 extending from each of the two adjacent rim portions 16. Each corner portion 114 comprises a corner lip member 144 (see FIG. 31A), which has the same function as the corner lip member 116 described above.

As shown in FIG. 31A, each corner aperture 142 is substantially L shaped, having a substantially right angled bend to allow it to extend around the respective corner. A region of each corner aperture 142 thus extends substantially parallel to the apertures 42 defined in the adjacent rim portions 16. Each corner aperture 142 has a first region 142A extending from, or aligned with, one of the apertures 42 of one of the adjacent rim portions 16. Each corner aperture 142 also has a second region 142B extending from one of the apertures 42 of the other of the adjacent rim portions 16. The first and second regions 142A, 142B of each corner aperture 142 extend substantially perpendicular to each other.

Figure 32:
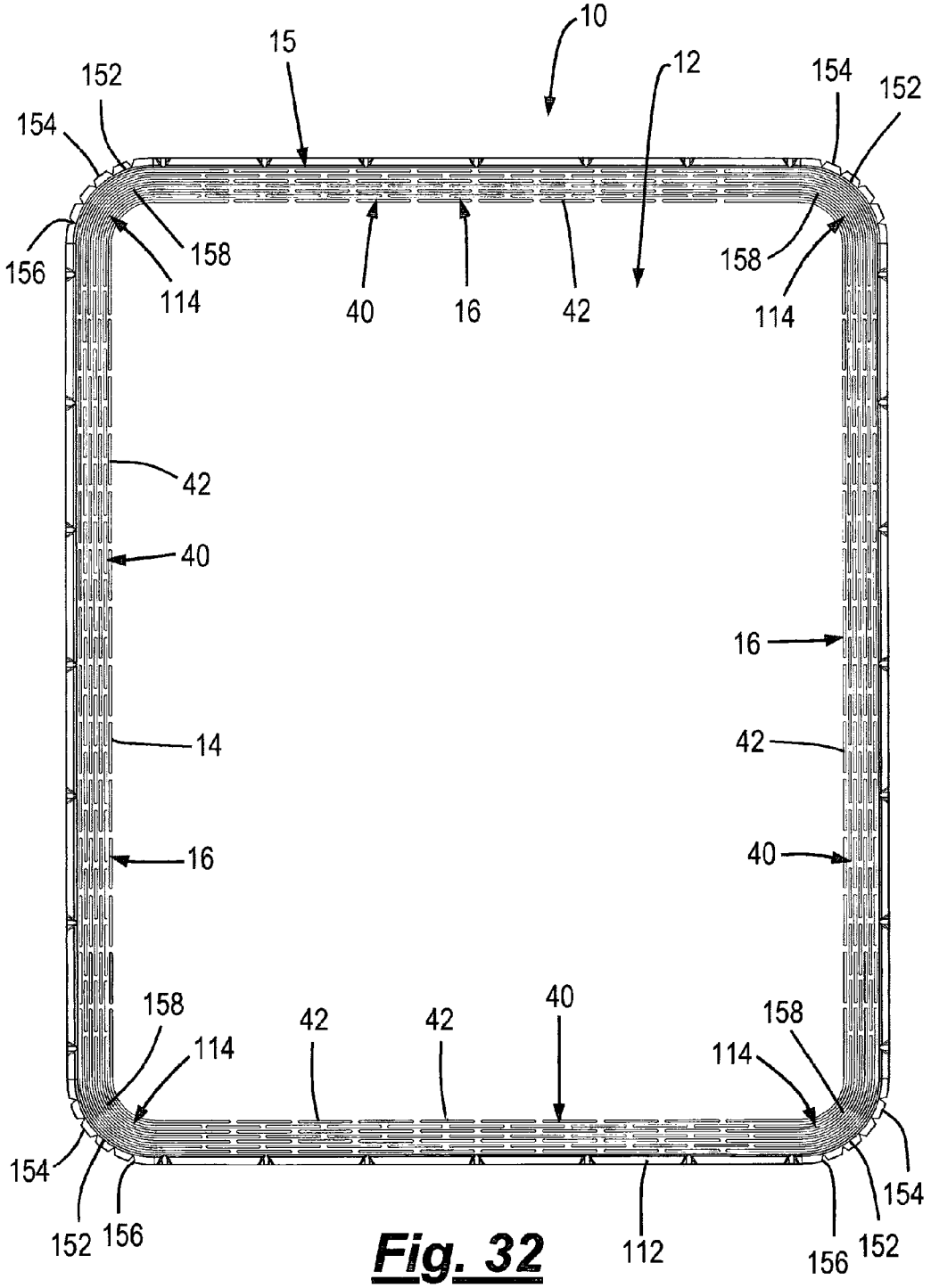
FIG. 32 is a top plan view of an eleventh embodiment of the load capping arrangement.
Figure 32A:
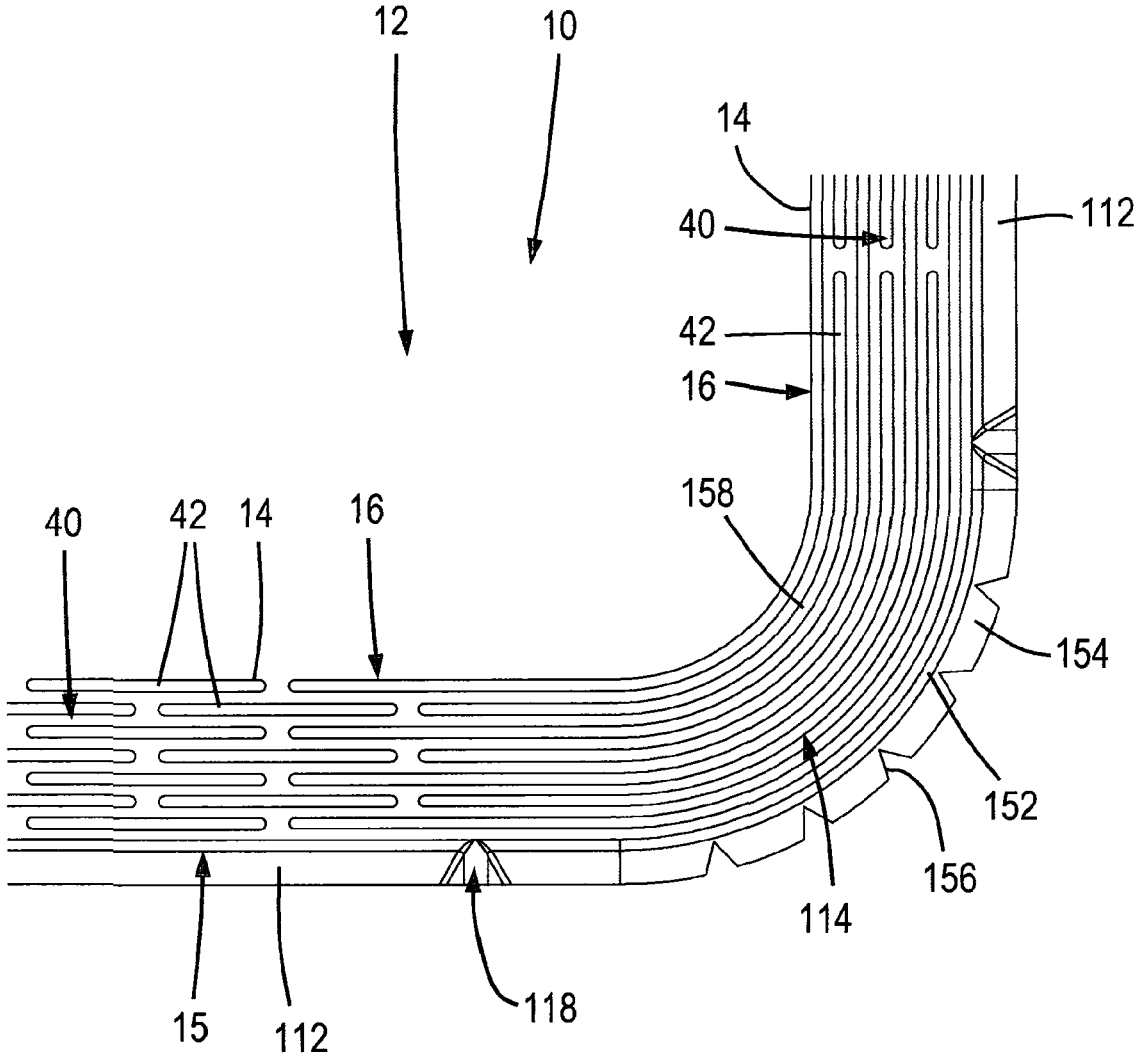
FIG. 32A is a close up view of a corner portion of the load capping arrangement shown in FIG. 32.

In yet another embodiment, shown in FIGS. 32 and 32A, each corner portion 114 has a curved edge 152. Each corner portion 114 also has a convexly curved corner lip member 154, similar to the corner lip members 116, 144 described above. The corner lip member 154 defines a plurality of notches 156 to facilitate the deformation of the corner portion 156 to a deformed condition. In this embodiment, each corner portion 114 defines a plurality of elongate curved apertures 158 extending from one of the adjacent rim portions 16 to the other of the adjacent rim portions 16. Each of the curved apertures 158 is in the form of a curved slot.

The invention claimed is:

1. A load capping arrangement tar stabilizing a load which comprises a plurality of articles, wherein the load capping arrangement comprises a central region for engaging at least some of the articles, and a rim arrangement extending around the central region, the rim arrangement being deformable from a non-deformed condition to a deformed condition around the load, in which the rim arrangement can extend around the load, wherein the rim arrangement comprises a deformable region, said deformable region including a plurality of downwardly extending projections provided to engage the load, the projections being configured to hold the articles at the periphery of the load, and wherein the rim arrangement comprises a plurality of elongate torsion bars extending along the edge of the central region, and the rim arrangement comprises a plurality of elongate members, each elongate member extending along the edge of the central region, and each torsion bar comprises a portion of one of the elongate members.

2. A load capping arrangement according to claim 1, wherein the rim arrangement is resilient, being resiliently deformable from the non-deformed condition to the deformed condition, and is capable of resiliently returning from the deformed condition to the non-deformed condition.

3. A load capping arrangement according to claim 1, wherein the central region has a periphery and a plurality of sides defining the periphery, and the rim arrangement comprises a plurality of rim portions, each extending from the central region, each rim portion extending along the length of a respective side of the central region.

4. A load capping arrangement according to claim 1, wherein the central region comprises a substantially planar surface and the rim arrangement is deformable to extend from a first position in which the rim arrangement is substantially co-planar with, or parallel to, said substantially planar surface, to a second position transverse to said substantially planar surface.

5. A load capping arrangement according to claim 4, wherein the rim arrangement comprises a plurality of rim portions, each rim portion extending from the central region, and each rim portion being detonable to extend from a first position in which the rim portion is substantially co-planar with, or parallel to, said substantially planar surface, to a second position transverse to said substantially planar surface.

6. A load capping arrangement according to claim 5, wherein each rim portion comprises a foldable member attached to the central region, the foldable member being connected to the central region at a hinge.

7. A load capping arrangement according to claim 6, wherein each rim portion includes a plurality of foldable members attached to each, other at substantially parallel hinges extending across the rim portion.

8. A load capping arrangement according to claim 4, wherein the rim arrangement has an article engaging surface, and the rim arrangement is attached to the central region with the article engaging surface of the rim arrangement substantially co-planar with, or parallel to, the aforesaid planar surface of the central region when the rim arrangement is in the first position.

9. A load capping arrangement according to claim 1, wherein the deformable region defines a plurality of elongate formations, wherein each formation is either an aperture or a recess, the formations being arranged in rows, each row extending along the periphery of the central region, wherein the formations are apertures.

10. A load capping arrangement according to claim 9, wherein the torsion bars are provided between adjacent formations, and extend along the edge of the central region from which the rim arrangement extends, the torsion bars being arranged between adjacent rows of apertures.

11. A load capping arrangement according to claim 9, wherein the formations have edges, and the projections are provided at one or more of the edges of the formations.

12. A load capping arrangement according to claim 1, wherein the torsion bars are arranged in a plurality of rows, and the rim arrangement includes a plurality of connecting members extending between the torsion bars in adjacent rows of torsion bars, and wherein each torsion bar extends between adjacent connecting members.

13. A load capping arrangement for stabilizing a load which comprises a plurality of articles, wherein the load capping arrangement comprises a central region for engaging at least some of the articles, and a rim arrangement extending around the central region, the rim arrangement being deformable from a non-deformed condition to a deformed condition around the load, wherein the load capping arrangement further comprises a lip arrangement extending around the rim arrangement, the lip arrangement curving downwardly from the rim arrangement, wherein the lip arrangement comprises a plurality of centring formations to allow the load capping arrangement to be centred on the load by a manipulating apparatus, each centring formation comprising a raised region of the lip arrangement, and wherein each raised region comprises an engagement surface for engaging the manipulating apparatus, each engagement surface extending transverse to the central region, and each engagement surface is substantially V or U shaped and extends substantially at right angles to the central region.

14. A load capping arrangement according to claim 13, wherein the rim arrangement comprises a plurality of rim portions, each extending from the central region, each rim portion extending along the length of a respective side of the central region, and wherein the lip arrangement comprises a plurality of side lip members, each side lip member extending along a respective one of the rim portions, each side lip member curving downwardly from the respective rim portion.

15. A load capping arrangement for stabilising a load which comprises a plurality of articles, wherein the load capping arrangement comprises a central region for engaging at least some of the articles, a rim arrangement extending around the central region, the rim arrangement being deformable from a non-deformed condition to a deformed condition around the load, and a plurality of centring formations arranged around the rim arrangement to allow the load capping arrangement to be centred, on the load by a manipulating apparatus, each centring formation comprising a raised region.

16. A load capping arrangement according to claim 1, wherein the central region is formed of a rigid material and the rim arrangement is resiliently deformable.

* * * * *